US006011825A

United States Patent [19]

Welch et al.

[11] Patent Number: 6,011,825

[45] Date of Patent: Jan. 4, 2000

[54] PRODUCTION OF $^{64}$CU AND OTHER RADIONUCLIDES USING A CHARGED-PARTICLE ACCELERATOR

[75] Inventors: Michael J. Welch, Creve Couer; Deborah W. McCarthy, Maryland Heights, both of Mo.; Ruth E. Shefer, Newton; Robert E. Klinkowstein, Winchester, both of Mass.

[73] Assignee: Washington University, St. Louis, Mo.

[21] Appl. No.: 08/694,905

[22] Filed: Aug. 9, 1996

Related U.S. Application Data

[60] Provisional application No. 60/002,184, Aug. 9, 1995.

[51] Int. Cl.$^{7}$ ..... G21G 1/10

[52] U.S. Cl. ..... 376/195

[58] Field of Search ..... 376/195, 245

[56] References Cited

U.S. PATENT DOCUMENTS

| | | | |
|---|---|---|---|
| Re. 34,575 | 4/1994 | Klinkowstein | 328/233 |
| 2,579,243 | 12/1951 | Reid | 204/154 |
| 3,549,492 | 12/1970 | Ricci et al. | 376/202 |
| 4,464,331 | 8/1984 | Bezer et al. | 376/202 |
| 4,487,738 | 12/1984 | O'Brien, Jr. et al. | 376/192 |
| 4,599,517 | 7/1986 | Lewis et al. | 376/202 |
| 5,037,602 | 8/1991 | Dabiri et al. | 376/198 |
| 5,280,505 | 1/1994 | Hughey et al. | 376/156 |
| 5,405,309 | 4/1995 | Carden, Jr. | 600/3 |
| 5,409,677 | 4/1995 | Zinn | 423/2 |
| 5,468,355 | 11/1995 | Shefer et al. | 204/157.2 |

FOREIGN PATENT DOCUMENTS

| | | | |
|---|---|---|---|
| 2066136 | 10/1992 | Canada | 376/245 |

OTHER PUBLICATIONS

Maziere et al. "[$^{55}$Co]– and [$^{64}$Cu]DTPA: New Radiopharmaceuticals for Quantitative Tomocisternography" Appl. Radiat. Isot., vol. 34, No. 3 (1983) pp. 595–601.

Hetherington et al. "The Preparation of High Specific Activity Copper–64 for Medical Diagnosis" Appl. Radiat. Isot., vol. 37, No. 12 (1986) pp. 1242–1243.

Vaalburg et al. "Fast Recovery by Dry Distillation of $^{75}$Br Induced in Reusable Metal Selenide Targets via the $^{76}$Se(p, 2n)$^{75}$Br Reaction" Int. J. Appl. Radiat. Isot., vol. 36 No. 12 (1985) pp. 961–964.

(List continued on next page.)

*Primary Examiner*—Harvey E. Behrend

*Attorney, Agent, or Firm*—Senniger, Powers, Leavitt & Roedel

[57] ABSTRACT

Radionuclides are produced according to the present invention at commercially significant yields and at specific activities which are suitable for use in radiodiagnostic agents such as PET imaging agents and radiotherapeutic agents and/or compositions. In the method and system of the present invention, a solid target having an isotopically enriched target layer electroplated on an inert substrate is positioned in a specially designed target holder and irradiated with a charged-particle beam. The beam is preferably generated using an accelerator such as a biomedical cyclotron at energies ranging from about 5 MeV to about 25 MeV. The target is preferably directly irradiated, without an intervening attenuating foil, and with the charged particle beam impinging an area which substantially matches the target area. The irradiated target is remotely and automatically transferred from the target holder, preferably without transferring any target holder subassemblies, to a conveyance system which is preferably a pneumatic or hydraulic conveyance system, and then further transferred to an automated separation system. The system is effective for processing a single target or a plurality of targets. After separation, the unreacted target material can be recycled for preparation of other targets. In a preferred application of the invention, a biomedical cyclotron has been used to produce over 500 mCi of $^{64}$Cu having a specific activity of over 300 mCi/$\mu$g Cu according to the reaction $^{64}$Ni(p,n)$^{64}$Cu. These results indicate that accelerator-produced $^{64}$Cu is suitable for radiopharmaceutical diagnostic and therapeutic applications.

38 Claims, 5 Drawing Sheets

OTHER PUBLICATIONS

Guillaume et al. "Automated Production of Potassium–38 for the Study of Myocardial Perfusion Using Positron Emission Tomography" Appl. Radiat. Isot., vol. 29, No. 2 (1988) pp. 97–107.

Ferrieri et al. "On–Line Production of $^{13}$N–Nitrogen Gas From a Solid Enriched $^{13}$C–Target and its Application to $^{13}$N–Ammonia Synthesis Using Microwave Radiation" Int. J. Appl. Radiat. Isot., vol. 34, No. 6 (1983) pp. 897–900.

Szelecsenyi et al. "Excitation Functions of Proton Induced Nuclear Reactions on Enriched $^{61}$Ni and $^{64}$Ni: Possiblity of Production of No–Carrier–Added $^{61}$Cu and $^{64}$Cu at a Small Cyclotron" Appl. Radiat. Isot., vol. 44, No. 3 (1993) pp. 575–580.

Nickles et al. "Production of a Broad Range of Radionuclides With an 11 MeV Proton Cyclotron" J. of Labelled Compounds & Radiopharmaceuticals, vol. 30 (Jan. 1991) John Wiley & Sons, Ltd., p. 120–121.

Zweit et al. "Excitation Functions for Deuteron Induced Reactions in Natural Nickel: Production of No–Carrier–Added $^{64}$Cu from Enriched $^{64}$Ni Targets for Positron Emission Tomography" Appl. Radiat. Isot., vol. 42, No. 2 (1991) pp. 193–197.

Anderson, C. J. "PET Imaging Radionuclide Copper–6$^{4}$ Tested as Radioimmunotherapy Agent" J. of Nuclear Med., vol. 34, No. 7 (Jul. 1993) p. 22N.

R.E. Williams "Pneumatic Sample– Transfer System for Use With the Lawrence Livermore National Laboratory Rotating Target Neutron Source (RTNS–I)" UCID–19161, Jul. 1981, Abstract of p. 42.

T. Sekine et al. "A New Radioisotope—Production Research Facility Utilizing Ion Beams From AVF Cyclotron" BNL–61149 (1994), Abstract of pp. 347–352.

W.Z. Gelbart et al. "High Current Radioisotope Production With Solid Target System" DOE/ER/40779–1–vol. 4 (1993). Abstract of pp. 3099–3101.

J.R. Dahl et al(I) "The Use of A Compact, Multi–Particle Cyclotron for the Production of Fe, Ga, In and I for Medical Purposes" International Journal of Applied Radiation and Isotopes, vol. 23, No. 9 (1972) pp. 431–437.

Kirby, L. J. "The Radiochemistry of Nickel", Nuclear Science Series, (Nov. 1961) pp. 32–36.

Rosch et al. "Nuclear Data Relevant to the Production of the Positron Emitting Technetium Isotope $^{94m}$Tc via the $^{94}$Mo (p,n)—reaction" Radiochimica Acta, vol. 62 (1993) pp. 115–121.

Mushtag et al. "Excitation Functions of α– and $^{3}$He–Particle Induced Nuclear Reactions on Natural Germanium: Evaluation of Production Routes for $^{73}$Se" Radiochimica Acta, vol. 50 (1990) pp. 27–31.

Sharma et al. "Production of Cobalt–55, a Short–lived, Positron Emitting Radiolabel for Bleomycin" Appl. Radiat. Isot., vol. 37, No. 2 (1986) pp. 105–109.

Piel et al. Excitation Functions of (p,xn)–Reactions on $^{nat}$Ni and Highly Enriched $^{62}$Ni: Possibility of Production of Medically Improtant Ratioisotope $^{62}$Cu at a Small Cyclotron, Radiochim Acta, vol. 57 (1992) pp. 1–5.

Mirzadeh et al. "Production of No–Carrier Added $^{67}$Cu" Appl. Radiat. Isot., vol. 37, No. 1 (1986) pp. 29–36.

Hanley et al. "Water Cooled Targets for Intense Ion Beams" IEEE Trans. Nuc. Sci. (Jun. 1967) pp. 933–937.

Michael et al. "Some Tehcnical Improvements in the Production of $^{123}$I via the $^{124}$Te(p, 2n) $^{123}$I Reaction at a Compact Cyclotron" Int. Jour. of Applied Radiation and Isotopes, vol. 32 (1981) pp. 581–587.

"Accelerator Production of Cu–64 for Pet and Radiotherapy" U.S. Dept. of Health & Human Services (SBIR) Phase I and Phase II Projects, Abstract Book (1995) pp. 75–76, Shefer.

"Development of Kits for the Efficient and Automated Synthesis of Copper–64 Radiopharmaceuticals" U.S. DOE, STTR Abstracts of Phase I Awards, No. 7 (1994) p. 6.

"Development of Kist for the Efficient and Automated Synthesis of Copper–64 Radiopharmaceuticals" U.S. DOE, STTR Abstracts of Phase II Awards (1995) p. 2.

Zinn et al. "Production and Purification of High Specific Activity Cu–64 for PET Imaging" J. Nucl. Med., vol. 34 (1993) p. 238.

Herr et al. "Preparation of Practically Carrier–Free Copper–64 from High Activity Copper Phthalocyanine" Z. Nature Forsch. vol. 5a (1950) p. 629.

BNL–61149, Dahl et al(II)(editors), pp. 5–8, 130–133, 245–248, 276–282, 347–352, 360–363, Sep. 1993.

Annual Report Jun. 1986 (National Accelerator Centre, Faure, South Africa, pp. 41,42,95,118,133–139, 154, 155, Jun. 1986.

DOE/ER/40779–1, vol. 4, pp. 3099–3101, Gelbart et al, 1993.

Nucl. Instruments and Methods in Physics Research A, vol. 355, Nos. 2,3, pp. 236–241, Nortier et al, Feb. 1995.

PSI–PROC–92–01, Weinreich (editor), pp. 174–185, Aug. 1992.

UDIC–19161, Williams et al, pp. 1–40, Jul. 1981.

Int. J. Appl. Radiat. Isot., vol. 36, No. 6, pp. 469–474, Vandewalle et al, 1985.

Int. J. Appl. Radiat. Isot., vol. 26, pp. 763–770, Servian, 1975.

Nuclear Instruments and Methods in Physics Research, B10/11, pp. 969–971, Bolomey, May 1985.

Proc. 11th Int. Conf. on Cyclotrons and Their Applications, Tokyo, Japan, pp. 634–637, Burgerjon et al, Oct. 1986.

PRODUCTION OF $^{64}$CU AND OTHER RADIONUCLIDES USING A CHARGED-PARTICLE ACCELERATOR

The present invention claims priority to copending United States provisional application Ser. No. 60/002,184, filed Aug. 9, 1995.

This invention was developed, in part, through research supported by grants from the National Institutes of Health (SBIR R43-CA66411-01) and the Department of Energy (STTR DE-FG02-94ER86015 and DE-FG02-87ER60512). The U.S. government may have certain rights in this invention.

BACKGROUND OF THE INVENTION

The present invention generally relates to the production of radionuclides suitable for use in diagnostic and therapeutic radiopharmaceuticals, and specifically, to a system and method for producing radionuclides from a solid target material using a low or medium energy charged-particle accelerator. The invention particularly relates, in a preferred embodiment, to a system and method for producing $^{64}$Cu and other intermediate half-lived positron-emitting radionuclides using a biomedical cyclotron capable of generating protons at energies ranging from about 5 MeV to about 25 MeV.

Low or medium energy charged-particle accelerators such as biomedical cyclotrons have been used to produce short-lived radionuclides such as $^{15}$O ($t_{1/2}$=2 minutes), $^{13}$N ($t_{1/2}$=9.96 minutes), $^{11}$C ($t_{1/2}$=20.4 minutes) and $^{18}$F ($t_{1/2}$=110 minutes) from gaseous target sources. The on-site production of these radionuclides at medical research and/or treatment centers facilitate their immediate use in diagnostic and therapeutic applications. However, other radionuclides which have become increasingly important for such applications are not currently available using an on-site accelerator in commercially significant yields and at specific activities suitable for diagnostic and therapeutic uses. For example, $^{4}$Cu is an intermediate half-lived positron-emitting radionuclide ($t_{1/2}$=12.7 hours) which is a useful radiotracer for positron emission tomography (PET) as well as a promising radiotherapy agent for the treatment of cancer. (Anderson et al., 1992; Anderson et al., 1993; Connett et al., 1993; Philpott et al., 1993; Anderson et al., 1994; Anderson et al., 1995a; Anderson, et al., 1995b). However, $^{64}$Cu is presently produced in clinically significant yields and specific activities only through fast neutron reactions using a nuclear reactor. (Herr and Botte 1950; Zinn et al., 1993) Reactor production of $^{67}$Cu at lower specific activities using a thermal neutron flux according to the reaction $^{63}$Cu(n,γ)$^{64}$Cu has also been reported. (Hetherington et al., 1986). As such, $^{64}$Cu is currently available for the preparation of radioimaging and radiotherapeutic agents only in limited quantities and on a limited basis via the fast neutron reaction using a nuclear reactor. Hence, improved methods are needed for producing $^{64}$Cu and other radionuclides from solid target materials using readily available in-house accelerators.

The feasibility of using a hospital-sized proton cyclotron for producing a broad range of radionuclides, including $^{64}$Cu, has been investigated. (Nickles et al. 1991). Cylclotron production of $^{64}$Cu has been reported from pressed powder pellets of elemental $^{64}$Ni according to the reaction $^{64}$Ni(d,2n)$^{64}$Cu (Zweit et al., 1991), and from a stack of enriched $^{64}$Ni plated foils according to the reaction $^{64}$Ni(p,n)$^{64}$Cu (Szelecsenyi et al., 1993). Co-production of $^{55}$Co and $^{64}$Cu from a nickel foil soldered onto a copper or stainless steel support has also been reported. (Maziere et al., 1983). These approaches, while confirming the feasibility of producing $^{64}$Cu, did not produce clinically significant amounts of $^{64}$Cu and did not produce $^{64}$Cu at a specific activity which was suitable for use in clinical radiopharmaceutical diagnostic and/or therapeutic compositions. Moreover, these approaches did not address the practical difficulties encountered in scaling up to the high power irradiation required for such commercially useful production.

The use of a cyclotron accelerator for producing other radionuclides is reported in U.S. Pat. No. 4,487,738 to O'Brien et al. ($^{67}$Cu), Mirzadeh et al., 1986 ($^{67}$Cu), Piel et al., 1991 ($^{62}$Cu), Sharma et al., 1986 ($^{55}$Co), Mushtaq and Qaim, 1989 ($^{73}$Se), Michael et al., 1981 (123I), Guillaume et al., 1988 ($^{38}$K), Vaalburg et al., 1985 ($^{75}$Br), Rosch and Qaim, 1993 ($^{94m}$Tc) and Ferrier et al., 1983 ($^{13}$N from solid $^{13}$C). While these references disclose various reactions, targets, target holders, conveyance systems and separation systems, the references do not provide a comprehensive system or method for the automated, in-house production of radionuclides from solid targets in significant yields and at specific activities suitable for diagnostic or therapeutic use.

SUMMARY OF THE INVENTION

It is therefore an object of the present invention to produce $^{64}$Cu or other radionuclides from a solid target material using a low or medium energy charged-particle accelerator such as a cyclotron commonly found on-site at major medical treatment and/or research facilities. It is also an object to produce radionuclides in commercially significant yields and at specific activities which are suitable for use in diagnostic and therapeutic applications. It is a further object to provide a system in which such production is effected remotely, with minimal human intervention and therefore, without significant human exposure to ionizing radiation. An additional object of the invention is to minimize the expense of preparing such radionuclides.

Briefly, therefore, the present invention is directed to a method for producing a radionuclide from a target nuclide using an accelerator capable of generating a beam of charged particles at energies of at least about 5 MeV. A solid target which includes the target nuclide is loaded in a target holder suitable for use with the accelerator, and irradiated with the charged-particle beam at energies of at least about 5 MeV to form the radionuclide. After irradiation, the irradiated target is remotely and automatically transferred, without direct human contact and without human exposure to measurable ionizing radiation, from the target holder to an automated separation system. The irradiated target is transferred alone, in its own free form, without transferring any subassembly of the target holder. The radionuclide is then separated from unreacted target nuclide using the automatic and remotely operable separation system.

In a variation of this method, the irradiated target is transferred from the target holder to a pneumatic or hydraulic conveyance system which includes a transfer fluid moving through a transfer line, the fluid movement being effected by a motive force means. The irradiated target is conveyed using the pneumatic or hydraulic conveyance system, either in direct contact with the transfer and being entrained therein, or alternatively, in a transfer capsule which houses the target.

The invention is also directed to a method for producing a radionuclide from a target nuclide using an accelerator capable of generating a beam of charged particles at energies ranging from about 5 MeV to about 25 MeV. A solid target comprising the target nuclide is loaded in a target holder adapted for use with the accelerator. The target comprises a substrate and a target layer electroplated on a surface of the substrate. The substrate consists essentially of a material which is chemically inert relative to the target layer and which, preferably, has a thermal conductivity and a melting point which is at least about equal to the thermal conductivity and the melting point, respectively, of the target layer. The target layer consists essentially of a target nuclide capable of reacting with charged particles generated by the accelerator at energies ranging from about 5 MeV to about 25 MeV to form the radionuclide. The target layer has a projected thickness that will produce at least about 50% of the thick target yield for the energy at which the reaction takes place. This target is irradiated with a beam of charged particles generated by the accelerator for at least about one hour to form the radionuclide. The charged-particle beam has an energy ranging from about 5 MeV to about 25 MeV and a current sufficient to produce a clinically significant yield of the radionuclide.

In a preferred application, the present invention is directed to a method for producing clinical grade $^{64}$Cu suitable for use in preparing radiodiagnostic agents such as a PET imaging agent or for use in preparing radiotherapeutic agents suitable for use in clinical applications. A target comprising isotopically enriched $^{64}$Ni is irradiated with a proton beam to produce $^{64}$Cu according to the reaction $^{64}$Ni(p,n)$^{64}$Cu. The amount of $^{64}$Cu produced is at least sufficient for preparing a radiodiagnostic agent or, alternatively, at least sufficient for preparing a radiotherapeutic agent. The proton beam has an energy of at least about 5 MeV and a current at least sufficient to produce an amount of $^{64}$Cu sufficient for preparing a radiodiagnostic agent or, alternatively, at least sufficient for preparing a radiotherapeutic agent during the period of irradiation. The $^{64}$Cu is separated from unreacted $^{64}$Ni, and the separated $^{64}$Cu has a specific activity which is at least sufficient for clinical use in a radioimaging or radiotherapeutic agents.

The invention is further directed to a method for preparing a solid target which is suitable for use in producing a radionuclide using an accelerator capable of generating a beam of charged particles at energies ranging from about 5 MeV to about 25 MeV. A target material is electroplated onto a surface of a substrate consisting essentially of an inert material to form a target layer thereon. The target material consists essentially of a target nuclide capable of reacting with charged particles generated in the accelerator at energies ranging from about 5 MeV to about 25 MeV to form the radionuclide. The target layer has a projected thickness that will produce at least about 50% of the thick target yield for the reaction.

The invention is directed, as well, to a target holder for use with an accelerator to irradiate a solid target with a charged-particle beam generated by the accelerator at an energy greater than about 5 MeV for production of a radionuclide. The target holder comprises an elongated body having a first end and a second end and a passage therethrough extending from the first end to second end. The first end of the body is adapted to sealingly engage an accelerator capable of generating a beam of charged particles at an energy of at least about 5 MeV for the production of a radionuclide. The body also has an irradiation chamber which is defined in the body by the passage through the body. The second end of the body has a seat adapted to sealingly receive a solid target such that the target is in direct alignment with the charged-particle beam during irradiation of the target. The seat has an aperture for allowing fluid communication between the irradiation chamber and the target, thereby allowing the charged-particles generated by the accelerator during irradiation to travel unimpeded from the accelerator to the target. The body has at least one port in fluid communication with the irradiation chamber for drawing and sustaining a vacuum in the chamber or for pressurizing the chamber. A vacuum drawn in the chamber is effective to hold the target in the seat prior to or after irradiation. Pressure in the chamber is effective to act through the aperture in the seat to separate the target from the seat and eject the target for further processing after irradiation.

In another embodiment, the target holder comprises an elongated body having a first end and a second end and a passage therethrough extending from the first end to second end with the first end of the body being adapted to sealingly engage an accelerator, the passage through the body defining an irradiation chamber, and the second end of the body having a seat adapted to sealingly receive a solid target with the target in direct alignment with the charged-particle beam during irradiation of the target. The seat can include an aperture as described above, or alternatively, can include a window or a foil which separates the irradiation chamber from the target during irradiation. The irradiation chamber is generally adapted to sustain a vacuum during irradiation of the target. The target holder further comprises a cooling head adapted to simultaneously hold a plurality of targets. The cooling head includes a plurality of cavities and seats adapted to sealingly receive a target. Each seat has an aperture for allowing fluid communication between the respective cavity and the target. The head is retractable from the body and engageable with the body to successively hold each of the targets against the seat of the body during irradiation.

The invention is directed, moreover, to a system for use in producing a radionuclide from a target nuclide by irradiating the target nuclide with charged particles generated in an accelerator, the resulting radionuclide being useful for diagnostic or therapeutic radiopharmaceutical applications. The system comprises a solid target which includes a target nuclide capable of reacting with charged particles having an energy of at least about 5 MeV to form the radionuclide, an accelerator capable of generating a beam of the charged particles at an energy of at least about 5 MeV to irradiate the target, a target holder adapted for use with the accelerator for positioning the target in the charged particle beam during irradiation, the target holder including means for remotely unloading the irradiated target from the target holder after irradiation, and a pneumatic or hydraulic conveyance system to which the irradiated target is remotely transferred from the target holder.

Other features and objects of the present invention will be in part apparent to those skilled in the art and in part pointed out hereinafter.

BRIEF DESCRIPTION OF THE DRAWINGS

FIG. 1A is a schematic cross-sectional view and FIG. 1B is a bottom plan view.

FIG. 2B is a detail of the area indicated in FIG. 2A.

FIG. 3A and FIG. 3B are schematic cross-sectional views showing a cooling head of the holder alternatively retracted from (FIG. 3A) and engaged with (FIG. 3B) an elongated body which includes an irradiation chamber. FIG. 3C is a side plan view of a seat on one end of the body of FIG. 3A. FIG. 3D is a view of an embodiment of the target holder which includes a temperature sensing port. FIG. 3E is a schematic cross-sectional view of a target holder having a multiple-target cooling head and a pneumatic system for transferring the irradiated target after bombardment with a charged-particle beam. FIG. 3F is a detail of the area indicated in FIG. 3A.

The invention is described in further detail below with reference to the figures, in which like items are numbered the same in the several figures.

DETAILED DESCRIPTION OF THE INVENTION

The system and methods of the present invention provide for the automated production of radionuclides at significant yields and at specific activities suitable for use in radiodiagnostic agents such as PET imaging agents and/or radiotherapeutic agents and/or compositions. Briefly, one or more solid targets are positioned in a specially designed target holder and successively irradiated with a beam of charged-particles generated by an accelerator of the type typically found on-site at major research and/or treatment centers. The irradiated targets are automatically and remotely transferred to a pneumatic or hydraulic transfer line and conveyed to an automated separation system for separation of the radionuclide of interest from unreacted target material and from other radionuclides. In a preferred application of the invention, a biomedical cyclotron has been used to produce over 500 mCi of $^{64}$Cu having a specific activity of over 300 mCi/$\mu$g Cu according to the reaction $^{64}$Ni(p,n)$^{64}$Cu. These results indicate that accelerator-produced $^{64}$Cu is suitable for radiopharmaceutical diagnostic and therapeutic applications. The increased availability of $^{64}$Cu and other intermediate half-lived radionuclides will allow physicians and researchers to trace physiological events impossible to trace with commonly available radionuclides having shorter half-lives. Additionally, the intermediate half-lived radionuclides can be used at locations which are some distance from the site at which they are produced.

While many details of the present invention are described herein with reference to $^{64}$Cu, such references should be considered exemplary and non-limiting. The methods and apparatus disclosed herein are also applicable for producing other radionuclides, including other intermediate half-lived radionuclides and other positron emitting radionuclides, from a solid target material using a low or medium energy charged-particle accelerator.

Figure 1A:
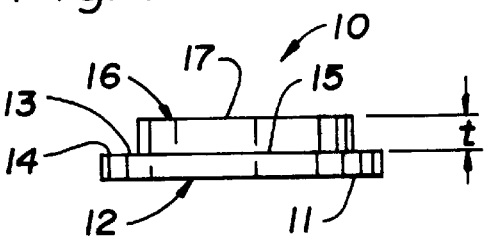
FIGS. 1A and 1B are views of a preferred target of the present invention.

FIG. 1A depicts a preferred target 10 which comprises a substrate 12 having a back surface 11 and a front surface 13 substantially parallel to and opposing the back surface 11. A target layer 16 having an exposed surface 17 is formed over the front surface 13 of the substrate 12. In a preferred embodiment, the target layer 16 covers a portion of the substrate surface 13, such that an edge margin 14 of the substrate surface 13 remains uncovered.

The target layer 16 consists of a target material that comprises a target nuclide capable of reacting with charged particles having energies ranging from about 5 MeV to about 25 MeV to form radionuclides suitable for use in diagnostic or therapeutic radiopharmaceuticals. $^{64}$Ni is a preferred target nuclide for producing $^{64}$Cu. Other target nuclides suitable for producing a variety of radionuclides are shown in Table 10 (Ex. 7).

The target material is preferably as isotopically pure as commercially possible with respect to the target nuclide. Isotopic purity of the target material impacts the production yield of the reaction. Target nuclides which are not naturally available in high concentrations are preferably isotopically enriched. While the degree of enrichment achievable and commercially available will vary depending on the target isotope, the target material preferably comprises at least about 75% target nuclide by weight, more preferably at least about 90% by weight, and most preferably at least about 95% by weight. For $^{64}$Cu production, the $^{64}$Ni is preferably at least about 95% enriched and more preferably at least about 98% enriched. The isotopic composition of commercially available 95% enriched $^{64}$Ni is representative of enriched $^{64}$Ni generally: 2.6% $^{58}$Ni, 1.72% $^{60}$Ni, 0.15% $^{61}$Ni, 0.53% $^{62}$Ni, and 95(±0.3%) $^{64}$Ni.

The target material is also preferably as chemically pure as commercially possible. The use of a target material that has a minimal amount of chemical impurities facilitates subsequent isolation and purification of the radionuclide of interest. The degree of chemical purity achievable and commercially available will generally vary depending on the target nuclide being used and the impurity of concern. To produce radionuclides having a high specific activity, it is especially preferred that the target material have a minimal amount of carrier impurities and/or other chemical impurities which are difficult to separate from the product radionuclide. The level of carrier impurities in the target material is preferably low enough to allow production of the radionuclide at specific activities sufficient for clinical use in a radiopharmaceutical imaging composition or in a radiopharmaceutical therapeutic composition. For $^{64}$Cu production, $^{64}$Cu imaging agents typically require a specific activity of at least about 15 mCi/$\mu$g Cu, whereas $^{64}$Cu therapeutic agents typically require a higher specific activity, usually ranging from about 100 mCi/$\mu$g to about 150 mCi/$\mu$g Cu. (Ex. 6). Commercially available $^{64}$Ni typically comprises natural copper carrier at a concentration of about 180 ppm by weight. $^{64}$Cu having a specific activity suitable for diagnostic and therapeutic applications was produced using such commercially available $^{64}$Ni target material. To achieve higher specific activities generally, the amount of carrier impurity present in commercially available target material is preferably reduced, for example, by purifying the target material prior to use in forming the target layer 16 over the substrate surface 13. For $^{64}$Cu production, carrier copper is preferably separated from the enriched nickel target material using the ionic exchange method discussed below for separating $^{64}$Cu produced by the present invention from unreacted $^{64}$Ni target nuclide.

The substrate 12 comprises a substrate material which is preferably chemically inert and capable of being separated from the target material and from the radionuclides produced during subsequent irradiation. The substrate material preferably has a melting point and a thermal conductivity which is at least about equal to the melting point and the thermal conductivity of the target material, respectively. Gold and platinum are preferred substrate materials. While the exact configuration (e.g. shape, thickness, etc.) of the substrate 12 is not narrowly critical, the substrate 12 is preferably shaped to facilitate use in a particular target holder and preferably thick enough to provide adequate support to the target layer 16 during irradiation. For use with the target holder of the present invention, the substrate 12 is preferably disc-shaped with diameters ranging from about 0.7 cm to about 3 cm and thicknesses ranging from about 0.5 mm to about 2 mm. The substrate 12 most preferably has a diameter of about 2 cm and a thickness of about 1 mm.

Figure 1B:
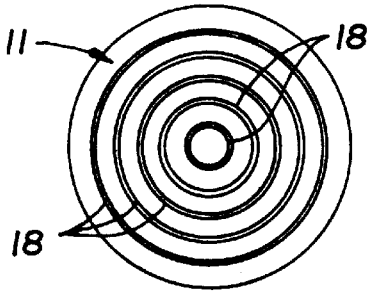

The back surface 11 of the substrate 12 preferably has an increased surface area relative to a flat, polished surface to improve heat transfer from the surface to a cooling medium flowing thereover during subsequent irradiation. For example, the back surface can be milled with grooves. The grooves are preferably patterned such that cooling medium will flow across the treated surface in a flow regime which is more turbulent and less laminar. In a preferred embodiment where the cooling medium flows radially outward from the center toward the periphery of the first substrate surface 11, concentric grooves 18 can be milled into the back surface 11 of the substrate 12. (FIG. 1B).

Figure 2A:
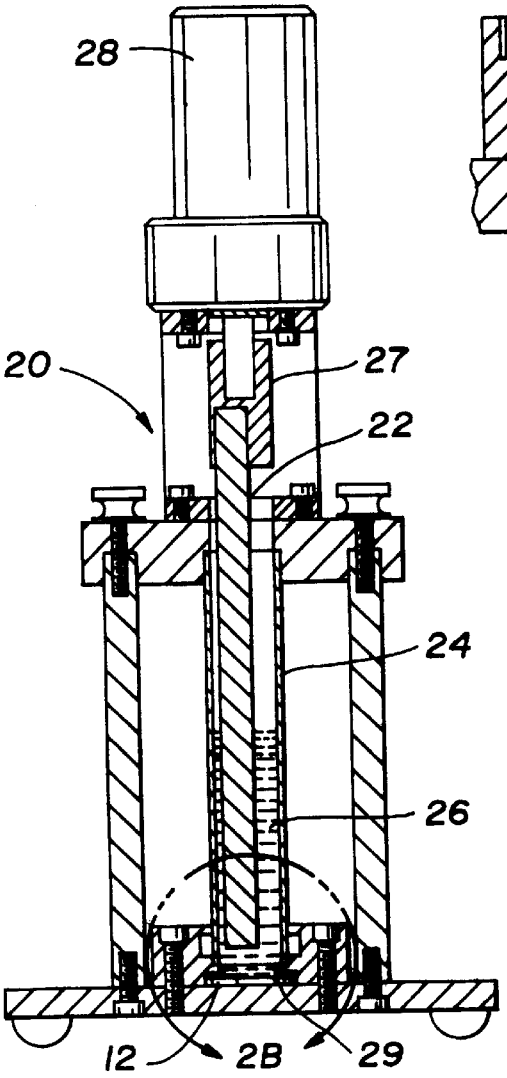
FIGS. 2A and 2B are schematic cross-sectional views of an electrolytic cell used for plating target material onto a substrate for preparing the preferred target.

The target layer 16 is preferably formed over a substrate surface by electroplating the target material onto the surface. (Example 1). Referring to FIG. 2A, the substrate 12 is used as the cathode in an electrolytic cell 20 that further comprises an anode 22 and a reservoir 24. An electrolytic solution 26 comprising the target material, in solvated form, is loaded into the reservoir 24. The electrolysis is effected at a voltage and current controlled, in conjunction with stirring and electrolytic solution addition, to result in smooth plating of the target material onto the substrate surface. The electrolytic solution 26 can be stirred during electrolysis using the anode 22 extending eccentrically from a coupling 27 on the shaft of a motor 28. The resulting electroplated target layer 16 contacts the substrate surface 13 at an interface 15 with a high degree of thermal integrity. Without being bound by theory, the heat transfer across the interface 15 is believed to be higher than the heat transfer across a corresponding interface for target layers formed by other methods such as packing and/or sintering powder target material into a cavity, soldering, etc. As such, the electroplated target layer 16 allows for improved heat transfer through the target 10.

The optimal thickness of the electroplated target layer 16 will vary depending on the target material, the optimal charged-particle beam energy and current, and the orientation of the target layer 16 with respect to the beam during subsequent irradiation. In general, however, the thickness, t, of the electroplated target layer 16, as measured normal to the surface 13 of the substrate 12, is preferably sufficient to result in a projected thickness which is preferably greater than the thickness that will produce at least about 50% of the thick target yield at the beam energy being used for the reaction. As used herein, the projected thickness refers to the thickness of the target layer measured in the direction of travel of the impinging charged-particle beam during irradiation, and can be determined based on the normal thickness, t, and the angle at which the surface 17 of the target layer is oriented relative to the beam path. The electroplated target layer more preferably has a projected thickness sufficient to produce at least about 75% of the thick target yield and most preferably, sufficient to produce at least about 90% of the thick target yield. For $^{64}$Cu production, the projected thickness required to produce greater than 90% of the thick target yield is about 350 $\mu$m at 16 MeV and about 20 $\mu$m at 5 MeV. Hence, at energies ranging from about 5 MeV to about 25 MeV, the projected thickness of the $^{64}$Ni target layer preferably ranges from about 20 $\mu$m to about 500 $\mu$m. The time required to obtain the desired thickness will depend on a number of factors, including for example, the concentration of the target nuclide in the electrolytic solution, the electrolysis current, and the amount of target nuclide being deposited onto the substrate. A $^{64}$Ni target layer having a projected thickness ranging from about 20 $\mu$m to about 350 $\mu$m can be electroplated over a gold substrate for use production of $^{64}$Cu in about 12 to about 24 hours.

Figure 2B:
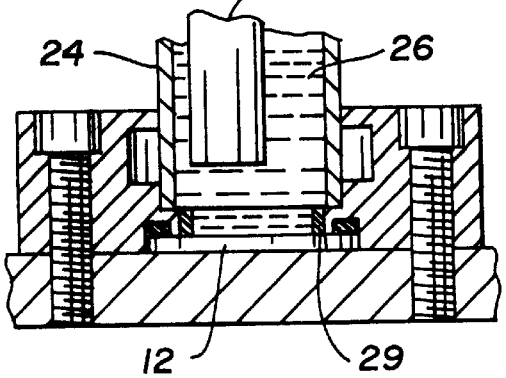

The shape and dimensions of the electroplated target layer 16 are not narrowly critical. The target layer 16 can be geometrically or irregularly shaped and have dimensions (length, width, diameter, etc.) which are appropriate to that shape. The shape and dimensions of the target layer define a target area which preferably substantially matches the impingement area of the charged-particle beam during subsequent irradiation. The difference in dimensions and/or total surface area between the target area and the beam impingement area is preferably less than about 20% and more preferably less than about 10%. In a preferred target preparation process, the target area of the target 10 can be matched to an anticipated charged-particle beam impingement area (known or predetermined) by inserting a spacer 29 to mask the edge margin 14 of the front surface 13 of the substrate 12. (FIG. 2B). For circular-shaped impingement areas, the spacer 29 can be an annular-shaped spacer. In general, however, the shape and/or dimensions of the spacer 29 can be varied to result in a target layer having a shape and dimensions that match the impingement area.

Figure 3A:
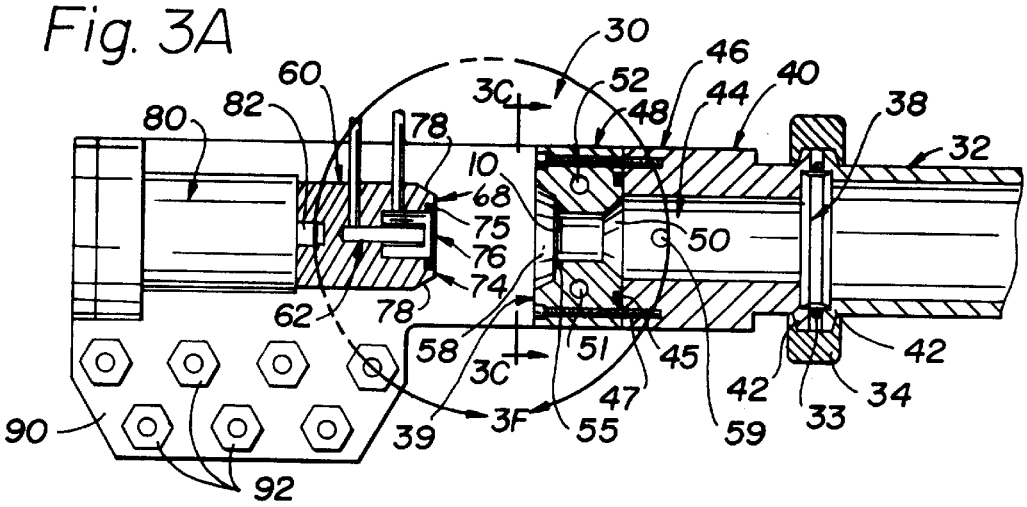
FIGS. 3A through 3F are views of a preferred target holder of the invention.
Figure 3B:
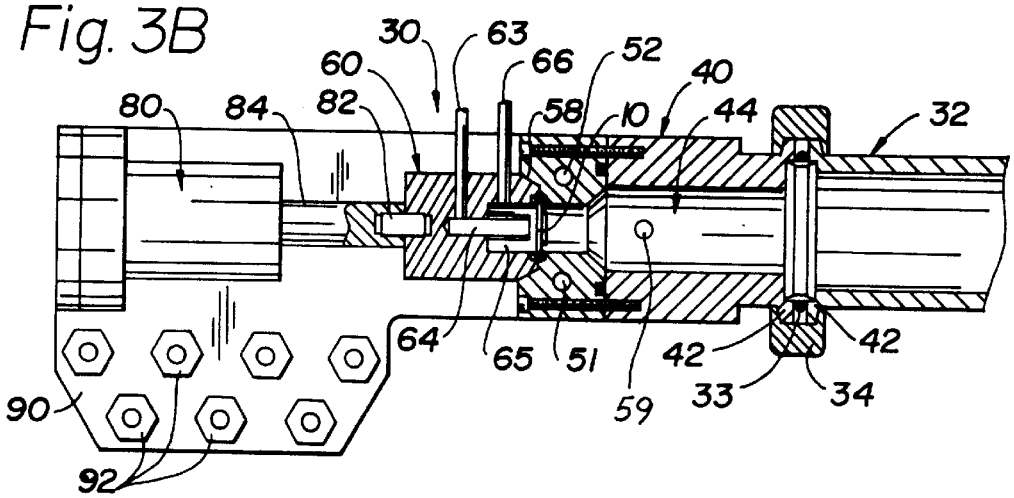

Referring to FIGS. 3A and 3B, a target 10 is positioned in the anticipated charged-particle beam path of a low or medium energy accelerator by loading the target into a target holder 30 adapted for use with the accelerator. While the target 10 described above is a preferred target, the target holder 30 can be adapted to accommodate other target designs. For example, where the target material being irradiated is available in isotopically pure form, has adequate strength and is not prohibitively expensive, the target can consist completely of the target material without a supporting substrate. The target is preferably aligned with the anticipated beam path such that the entire beam cross-section impinges the target layer. Alignment is particularly preferred where the target area and the anticipated impingement area are matched.

The target holder 30 preferably comprises an elongated body 40 and a cooling head 60 which may be alternatively retracted from (FIG. 3A) or engaged with (FIG. 3B) the body 40. The body 40 has a first end 38 adapted to sealingly engage the accelerator, a second end 39, and an irradiation chamber 44 defined by a passageway through the body 40, the irradiation chamber 44 extending from the first end 38 to the second end 39 of the body 40. The irradiation chamber 44 may comprise first and second hollow chamber blocks 46, 48 sealingly joined together by means of an O-ring 45 and fasteners 47. The body 40 can engage an external accelerator beam housing 32 through target holder-accelerator flanges 42 with a seal being formed therebetween by O-ring 33. Insulating break 34 electrically isolates the body 40 from the beam housing 32. The body 40, more particularly the second chamber block 48, can include an internal tapered section 50 for collimating and/or focusing the charged-particle beam during irradiation. The irradiation chamber 44 includes the hollow space on either side of the tapered section 50 of the second block 48. To facilitate removal of heat generated by attenuation of the charged-particles in the internal tapered section 50, the body 40 is cooled by circulating a cooling medium such as water through a body-cooling cavity (not shown) in the second chamber block 48 and in near proximity to the internal tapered section 50 of the body 40. The cooling water is circulated through the body-cooling cavity via inlet and outlet ports 51, 52, respectively.

Figure 3C:
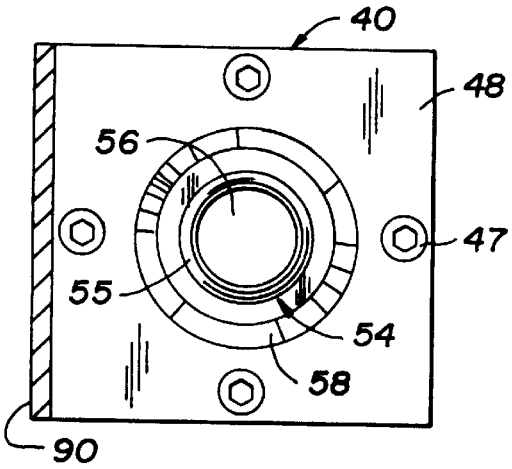

Referring to FIG. 3C, the body 40 includes an annular front seat 54 adapted to sealingly receive a solid target 10 so that the target is in direct alignment with the charged-particle beam during irradiation of the target. O-ring 55 is used to seal the target 10 against the seat 54. The front seat 54 has an aperture 56 for allowing fluid communication between the irradiation chamber 44 and the target, thereby allowing the charged-particles generated by the accelerator during irradiation to travel unimpeded from the accelerator to the target 10, passing along the way through the beam housing 32 and the irradiation chamber 44 of the body 40. The ability to directly impinge the charged-particles against the target, without passing through any protective or attenuating foil (e.g. a Havar foil) offers several advantages over conventional target holders which employ such foils. The target holder 30 is less complex mechanically relative to such conventional holders and, as such, provides for simplified construction and operation. Additionally, the risk of foil rupture and associated potential damage to the accelerator is markedly reduced because the accelerator pressure boundary does not comprise the thin foil. Moreover, because there is no degradation of beam energy from the foil, on-site accelerators can operate at their design energies. This allows for maximizing the yield of the reaction, which contributes to a higher specific activity. As discussed below, the absence of such a foil also allows for direct sensing of the target surface being irradiated during irradiation. The body 40 also includes a tapered recess 58 at its second end 39 concentric with the aperture 56 and adapted to generally receive the cooling head 60 when the cooling head is engaged.

Figure 3D:
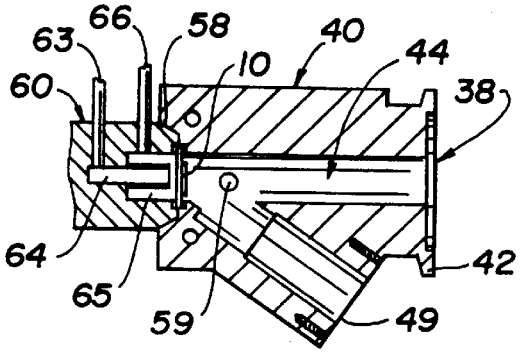

Referring to FIG. 3D, an alternative embodiment of the body 40, shown here as a one-piece body, additionally includes a temperature sensing port 49 for receiving a remote temperature sensing device such as an infrared pyrometer or an infrared thermocouple. The temperature sensor is preferably sealingly engaged with the temperature sensing port 49 and positioned in sensing communication with the target 10. The sensor has the ability to communicate with a surface of the target through the irradiation chamber 44 of the body 40 and through the seat aperture 56, thereby allowing the temperature of the target 10 to be directly sensed while the target is being irradiated. In the preferred target embodiment, the sensor directly senses the temperature of the surface 17 of target layer 16. The temperature sensor can be interlocked with the accelerator such that the accelerator shuts down if the surface temperature of the target exceeds a predetermined setpoint (e.g. 200° C. less than the melt temperature of the target material).

Figure 3E:
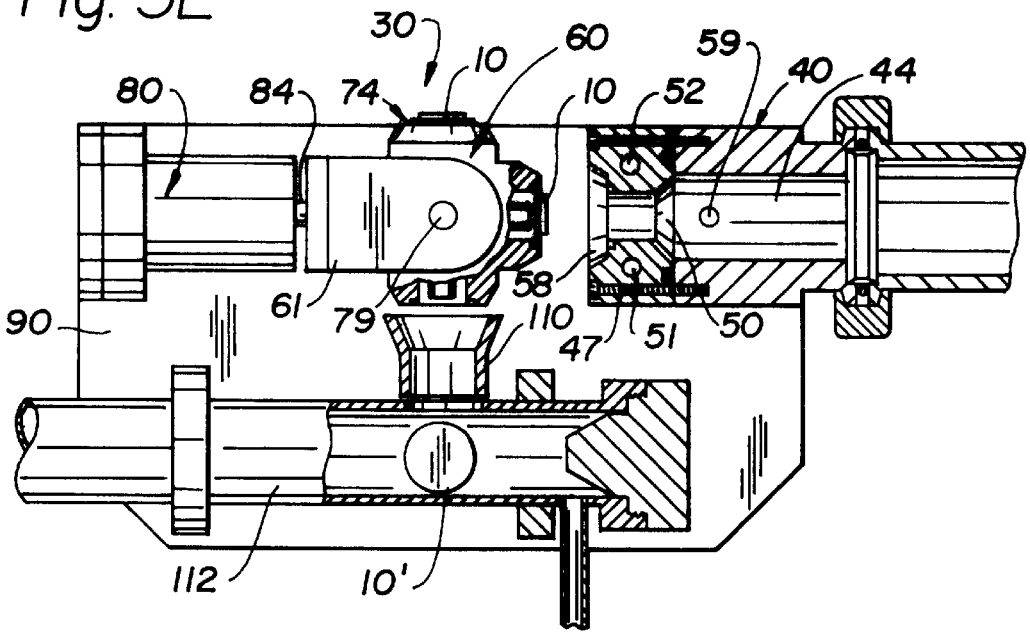

The cooling head 60 of the target holder 30 can hold a single target 10 (FIGS. 3A and 3B) or, in an alternative embodiment, be adapted to simultaneously hold a plurality of targets 10. (FIG. 3E). In either embodiment, the cooling head 60 is combined with means for alternatively retracting the head 60 from the body 40 to load or unload targets 10 (FIGS. 3A and 3E) and engaging the head 60 with the body 40 for irradiation (FIG. 3B). The means for retracting and engaging the cooling head 60 are not narrowly critical. As shown in the depicted embodiment, the retracting and engaging means includes an in-line actuator 80 linked to the single-target head 60 via a coupler 82 (FIGS. 3A and 3B) and to the multiple-target head 60 via carriage arm 61 (FIG. 3E). The actuator 80 includes piston rod 84 which may be pneumatically, hydraulically or solenoid actuated. In an alternative embodiment (not shown), the retracting and engaging means may include a series of linked armatures for swinging the cooling head 60 into or out of the engaged position. The actuator 80 and cooling head 60 assembly is mounted on a frame 90 which is integral with the body 40 or has the latter attached thereto. The frame 90 facilitates coordinated alignment of the actuator 80, the cooling head 60 and the body 40. The frame 90 includes a plurality of connectors 92 for facilitating connection and interconnection of various target holder utilities such as cooling medium, pressurized gas, vacuum ports, etc.

The cooling head 60 includes, at its end closest the body 40, a back seat 74 adapted to sealingly receive the back surface 11 of the target substrate 12 by means of an O-ring 75. The back seat 74 preferably includes a recess or aperture 76 for allowing fluid communication between the cavity and the target to allow a cooling medium such as water to flow over the backside of the target 10, as described below. The cooling head 60 also includes a tapered surface 78 concentric with the back seat 74 and aperture 76, the degree of taper of the tapered surface 78 being substantially the same as the degree of taper of the aforesaid tapered opening 58 of the body 40, such that the cooling head 60 is adapted to be generally received by the body 40 when the cooling head 60 is engaged therewith.

Referring to FIG. 3E, the multiple-target embodiment of the cooling head 60 is adapted to simultaneously hold a plurality of targets and to engage with the body to successively hold each of the targets against the seat of the body. The cooling head 60 includes a plurality of back seats 74, each of which is adapted to sealingly engage the back surface 11 of a target 10. Each seat 74 generally comprises the same elements as described above for the single-target embodiment. The multiple-target cooling head 60 is supported by the carriage arm 61 and rotatably linked thereto via pivot pins as illustrated at 79. The head 60 can be driven by a stepper motor to rotate about the pivot axis at 79 in an indexed manner. The successive indexed alignment of each of the plurality of cooling-head back seats 74 with the irradiation chamber 44 in the body 40 facilitates the automatic and remote transfer and positioning of each of the plurality of targets 10 between the back and front seats 74, 54 of the cooling head 60 and the body 40, respectively.

Figure 3F:
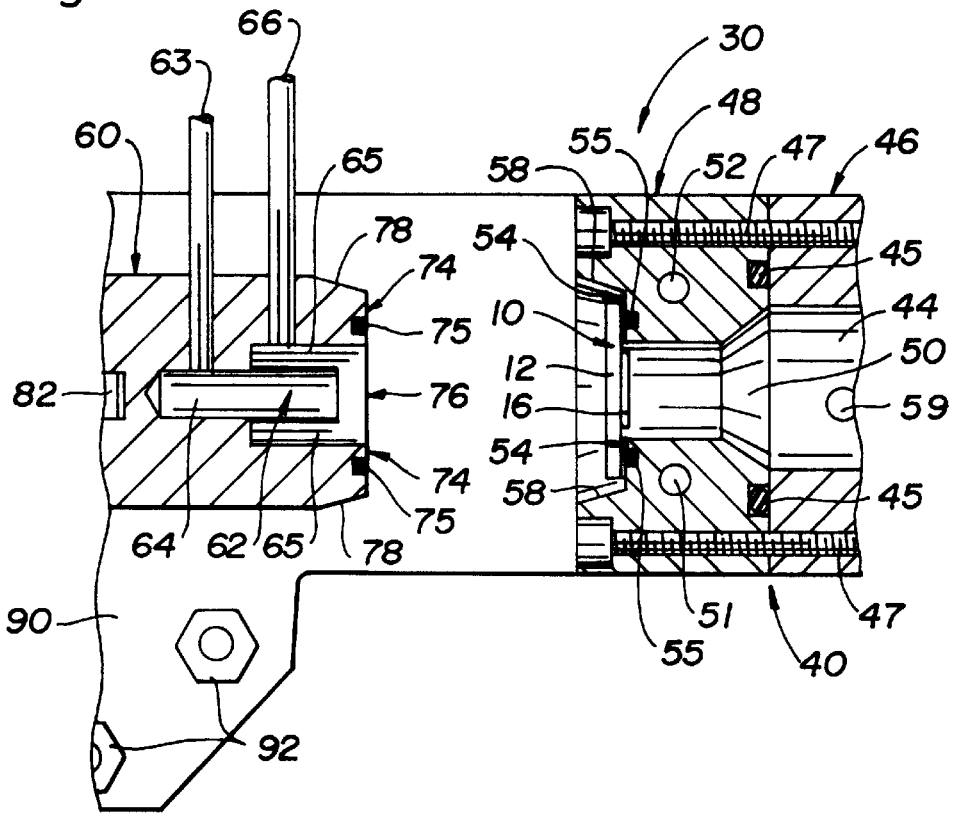

The target 10 is positioned in the target holder 30 by initially loading the target in either the irradiation chamber 40 or in the cooling-head 60. To load the target 10 initially in the front seat 54 of the body, the irradiation chamber 44 of the body 40 is brought in fluid communication with a vacuum source by means of vacuum port 59 and a preliminary vacuum is drawn and sustained in a space defined by a pressure boundary which includes the irradiation chamber 44 of the body 40. The space in which the preliminary vacuum is drawn can also include a downstream portion of the beam housing 32 which has been isolated from the upstream portion of the beam housing 32 and from the accelerator by shutting a gate valve (not shown) mounted in the beam housing 32. The preliminary vacuum is preferably about 0.1 torr ($1.333\times10^4$ Pa). The target 10 is placed in the front seat 54 and as the O-ring 55 seals against the target 10, a vacuum is drawn in the isolated space and holds the target 10 on the seat 54. When the preferred embodiment of the target 10 is being used, the front seat 54 and O-ring 55 preferably seal against the edge margin 14 of the front surface 13 of the substrate 12 such that target layer 16 is inserted into the aperture 56 of the seat 54 (FIG. 3F), thereby allowing subsequently for direct irradiation with the charged-particle beam.

To load the target initially in the back seat 74 of the cooling head 60, a preliminary vacuum is drawn in an internal hollow cavity 62 of the cooling head 60, which during subsequent irradiation, is used to cool the back surface 11 of the target 10. The cavity 62 is brought into fluid communication with a vacuum source via ports 63 and/or 66 and the target 10 is placed in the back seat 74. As the O-ring 75 seals against the target 10, a vacuum is drawn and sustained in a space defined by a pressure boundary which includes the ports 63, 66, supply and return sections 64, 65 of the cavity 62, and the back surface 11 of the target 10 positioned to cover the aperture in the back seat 74. The preliminary vacuum holds the target 10 on the seat 74 until the cooling head 60 is subsequently engaged with the body 40. The multiple target embodiment of the cooling head 60 comprises a plurality of cavities 62 in which a preliminary vacuum may be drawn to hold a target 10 against each of the plurality of seats 74. The means for drawing a vacuum can be substantially the same as described above for the single-target embodiment.

When the single-target embodiment of the cooling head 60 is being used, the target 10 is preferably initially loaded in the body 40 to ensure accurate placement of the target 10. (FIG. 3A). In this embodiment, however, the target could also be loaded initially in the cooling head 60. When the multiple-target embodiment of the cooling head 60 is being used, a target 10 is preferably initially loaded in each of the plurality of seats 74 of the cooling-head 60. (FIG. 3E). Pre-loading a plurality of targets 10 in the cooling-head 60 allows for subsequent irradiation and further processing of the several targets in series, automatically and remotely, thereby producing commercially useful quantities of the radionuclide of interest with minimum human intervention and with minimum radiation exposure.

Regardless of whether the target 10 has been initially loaded in the body 40 or in the cooling-head 60, the cooling head 60 is engaged with the body 40. (FIG. 3B). The engagement is preferably carried out automatically and remotely by the action of the actuator 80. At this point, the target 10 is held securely and sealingly between the seats 54 and 74 of the body 40 and the cooling head 60, respectively, by the motive force provided by the actuator 80. If necessary, any vacuum drawn in the cavity 62 of the cooling head 60 may be broken.

A cooling medium, preferably water, is circulated through the cooling-head cavity 62 via inlet and outlet ports 63, 66 to cool the back surface 11 of the substrate 12 during irradiation. In a preferred embodiment, the cooling medium enters the hollow cavity 62 via inlet port 63, flows through supply section 64 of the cavity 62, impinges the center portion of the substrate back surface 11 , flows generally radially outward over the back surface 11 of the target 10 toward the periphery thereof, flows through return section 65 of the cavity 62 and exits the cooling head cavity 62 via outlet port 66. When the multiple target embodiment of the cooling head 60 is being used, the means for establishing cooling medium flow past the back of the target 10 can be substantially the same as described above for the single-target embodiment. The target 10 being irradiated is cooled via cooling medium flow through its cavity 62, while the plurality of targets 10 not being irradiated at that time are held in place against their respective back seats 74 by the preliminary vacuum drawn through their respective cavities 62. Where subsequent separation steps favor the reduction of contaminants on the back surface 11 of the substrate 12 (e.g. if the entire irradiated target is immersed in a target layer dissolution agent), the cooling medium is preferably provided as free from contaminants, especially carrier impurities, as possible to avoid reducing the specific activity of the resulting radionuclide. The temperature and flow rate of the cooling medium are preferably controlled to maintain the temperature of the exposed target layer surface 17 at less than about 200 degrees less than the melt temperature of the target material and to maintain the temperature of the edge margin 14 of the front surface 13 of the substrate 12 at less than the melt temperature of the O-ring 55 (typically about 200 degrees C.). Cooling medium is also circulated through the cooling cavity in the vicinity of the internal tapered section 50 of the body via inlet and outlet ports 51, 52. A flow sensor can be interlocked with the accelerator such that the accelerator shuts down if cooling medium flow is reduced to below a predetermined setpoint.

For $^{64}$Cu preparation from $^{64}$Ni, a copper-free dedicated water supply system is preferably used to provide cooling water as the cooling medium, thereby minimizing the amount of copper carrier contamination to the back surface 11 of the substrate. Water is circulated through the cooling head at a temperature ranging from about 45° F. (about 7° C.) to about 90° F. (about 32° C.) and at a flow rate preferably ranging from about 1 l/min to about 100 l/min to maintain the exposed surface 17 temperature at less than about 1000 degrees C.

If not previously opened, the gate valve in the beam housing 32 is opened to expose the irradiation chamber 44 to the operational vacuum present in a low or medium energy charged-particle accelerator during irradiation. The vacuum, typically about $10^{-6}$ torr (0.1333 Pa), is sustained in the irradiation chamber, with the pressure boundary being defined by the accelerator, the external beam housing 32, the surface of the irradiation chamber 44 of the body 40 and the target 10 situated across the aperture 56 of seat 54.

The target material is then irradiated with a beam of charged particles to form the radionuclide of interest. The charged-particle beam can include protons, deuterons, alpha, $^{3}$He or electrons, depending on the target material, the nuclear reaction being effected, and the desired radionuclide being produced. The charged-particle beam is preferably generated in a low or medium energy accelerator, which, as used herein, includes accelerators capable of generating beams of charged-particles having an energy within the preferred range of about 5 MeV to about 25 MeV. However, the accelerator need not be capable of generating charged-particle beams over the entire preferred energy range. Moreover, the accelerator can be capable of generating beams having an energies outside of the preferred range, provided, that it is also capable of generating beams within this range. The particular accelerator design is not narrowly critical, and can include, for example, orbital accelerators such as cyclotrons, or linear accelerators such as Van de Graaff accelerators or RF linear accelerators. In-house cyclotrons of the type typically found on-site in research and/or treatment facilities are preferred accelerators, based on availability.

The beam energy is preferably greater than about 5 MeV. While higher energies are within the scope of the invention, the beam energy preferably ranges from about 5 MeV to about 25 MeV. Based on the capability of most in-house accelerators, the beam energy more preferably ranges from about 8 MeV to about 25 MeV and most preferably ranges from about 11 MeV to about 25 MeV. The optimal beam energy will vary for different target materials and for different reactions, but can be evaluated based on the excitation function (ie, reaction cross-section versus incident particle energy) for the particular nuclear reaction. The beam current is sufficient to produce at an amount of radionuclide (as measured in curies) which is sufficient for clinical use in a radiopharmaceutical imaging or therapeutic agents or compositions. For $^{64}$Cu applications developed to date, the amount of $^{64}$Cu required for imaging agents ranges from about 3 mCi to about 10 mCi when administered, and therefore, the amount of $^{64}$Cu produced for preparing the compositions is preferably ranges from at least about 10 mCi to at least about 30 mCi. The amount of $^{64}$Cu presently used for therapeutical applications is typically higher than that used for diagnostic applications, and generally in excess of about 30 mCi to about 50 mCi, and typically require the production of an amount of $^{64}$Cu ranging from at least about 90 mCi to at least about 150 mCi. (Ex. 6). For production runs of $^{64}$Cu, the beam current is preferably sufficient to produce from at least about 200 mCi $^{64}$Cu to about 1 Ci of $^{64}$Cu. In general, the beam current preferably ranges from about 1 $\mu$A to about 1 $\mu$A when operating at about 5 MeV, from about 1 $\mu$A to about 150 $\mu$A at about 8 MeV, from about 1 $\mu$A to about 100 $\mu$A at about 11 MeV, from about 1 $\mu$A to about 60 $\mu$A at about 20 MeV, and from about 1 $\mu$A to about 45 $\mu$A at 25 MeV. Beam current at a particular energy or energy range will generally be limited by accelerator capabilities and/or by heat-transfer considerations. Direct monitoring of the temperature of the target layer surface 17 facilitates maximizing beam current without exceeding the target material melting point.

The charged-particle beam preferably impinges the target over an impingement area which preferably substantially matches the target area. Both the target area and the matching beam strike or impingement area are preferably as small as possible within heat transfer considerations. The amount of time for which the target is irradiated is not narrowly critical. Irradiation of the target nuclide at a particular current can generally be continued for a time sufficient to generate quantities or amounts of radioactivity of the radionuclide of interest which are sufficient for use in preparing radiodiagnostic and radiotherapeutic agents or compositions suitable for clinical applications. While the time required will vary depending on the nuclear reaction being effected and the beam energy and current, sufficient quantities of radionuclides can typically be produced by irradiating for a period of time ranging from about one-fifth of the half-life of the radionuclide being produced to about three times the half-life.

A preferred radionuclide, $^{64}$Cu is produced by irradiating a $^{64}$Ni target material with a proton beam to effect the reaction $^{64}$Ni(p,n)$^{64}$Cu. (Example 2). The proton beam is preferably generated using a compact cyclotron at the energies and currents described above. The $^{64}$Ni target is preferably irradiated at least about 1 hour, more preferably at least about 2 hours and most preferably at least about 4 hours. An irradiation time of 4 hours produces about 20% of the saturation yield. In a preferred method, the beam energy is at least about 5 MeV and the beam currents are sufficient to produce at least about 10 mCi of $^{64}$Cu and more preferably sufficient to produce at least about 100 mCi of $^{64}$Cu within about 36 hours, more preferably within about 24 hours, even more preferably within about 12 hours and most preferably within about 4 hours. Irradiation of about 55 mg of deposited $^{64}$Ni (95% enrichment) for 120 $\mu$Ah resulted in about 600 mCi $^{4}$Cu being produced prior to separation. (Example 2). Useful isotope yields can be obtained at 4.1 MeV, 11.4 MeV, and 15.5 MeV proton energies. (Example 2). For example, a three hour bombardment at 45 $\mu$A will produce over 1 Ci of activity at 15–16 MeV and over 400 mCi at 11–12 MeV. A low energy, high current linear accelerator (operating at 4.1 MeV, 500 $\mu$A for example) could produce over 140 mCi of $^{64}$Cu activity in a three hour bombardment. Example 7 details the application of the present invention to other exemplary reactions.

After irradiation, the target holder utility systems (e.g. cooling medium circulation, vacuum, purge gas, etc.) can be automatically and remotely reconfigured to facilitate the remote transfer of the irradiated target from the target holder to, in a preferred method, an automated and remotely operable separation system. As detailed below, such transfer is preferably effected by remotely transferring the irradiated target to a pneumatic or hydraulic conveyance system, conveying the irradiated target therewith and remotely transferring the irradiated target to the separation system.

The steps and/or sequence of steps required in preparation for retracting the cooling head 60 from the body 40 and for unloading or releasing the irradiated target 10' from the target holder 30 are not narrowly critical, and are generally independent of whether the single-target cooling head or multiple-target cooling head embodiment is being used. Circulation of the cooling medium in both the cooling head 60 and the body 40 can continue after irradiation until ambient temperatures are achieved and maintained therein. The circulation of cooling medium to the cooling head 60 is then discontinued and the cooling medium is purged from the cooling-head cavity 62. To purge the cooling medium, inlet port 63 can be connected to a pressurized gas source (e.g. air or an inert gas such as nitrogen) which forces the cooling-medium out through outlet port 66. If desired, the cooling-medium flow to the body 40 is also discontinued.

In one method for unloading or releasing the irradiated target 10' from the target holder 30, the irradiation chamber 44 and the downstream portion of the beam housing 32 are isolated from the accelerator by shutting the gate valve located upstream of the target holder in the beam housing 32. The cooling head 60 is retracted from the body 40 by actuating the actuator 80. At this point, the irradiated target 10' is held against the body front seat 54 by the vacuum existing in the irradiation chamber 44 of the body 40 and by the seal friction between the target 10' and the O-ring 55. The irradiated target 10' is released from the front seat 54 of the body 40 by breaking the irradiation-chamber vacuum via port 59, and if necessary, pressurizing the irradiation chamber 44 of the body 40 using air or inert gas via port 59 so that the pressure in the chamber can act through the aperture in the seat to separate the target from the front seat 54 and eject the target for further processing. The overpressure preferably ranges from about slightly positive pressure (about 0.1 psig) to about 2 psig. ($1.151\times10^5$ Pa).

In an alternative method for unloading or releasing the irradiated target 10', the target holder utilities can be reconfigured such that the irradiated target is released from the cooling-head back seat 74 rather than the body front seat 54. For example, after the cooling medium flow is discontinued and the cooling-head cavity 62 purged as described above, the irradiation chamber 44 is isolated from the accelerator by shutting the gate valve in the beam housing 32, and the irradiation-chamber vacuum is broken via port 59. A vacuum is drawn in the cavity 62 via access ports 63, 66. The cooling head 60 is then retracted from the body 40, such that the irradiated target 10' is held against the back seat 74 by vacuum. The irradiated target 10' is released by breaking the cooling-head vacuum via port 63 and/or 66 and if necessary, overpressurizing the cooling-head cavity 62 by using air or inert gas via ports 63 and/or 66. The overpressure is substantially the same as described above for unloading the irradiated target 10' from the body. The irradiated target may be unloaded from the multiple target holder by substantially the same method.

Operation of the gate valve in the beam housing 32 upstream from the target holder 30 and control of the target holder utilities are preferably effected automatically and remotely. Specifically, the steps of drawing and breaking vacuums in the irradiation chamber 44 or in the cooling head cavity 62, establishing and discontinuing cooling medium flow through the cooling head cavity 62, purging the cooling head cavity 62, providing overpressure to either the back surface 11 through the cavity 62 or to the front surface 17 of the irradiated target 10' through the irradiation chamber are preferably effected remotely without direct human contact with the target holder or with the utility support system.

After the irradiated target 10' is released from the target holder 30 and transferred and/or conveyed away therefrom for further processing as discussed below, another target 10 can be positioned in the target holder 30 and irradiated. When the multiple target embodiment of the target holder 30 is being used, another of the plurality of targets can be positioned against the body front seat 54 by rotating the cooling head 60 to the next indexed position, and engaging the cooling head 60 with the body 30. The newly positioned target 10 can then be irradiated while processing the previously irradiated target 10'.

Figure 4:
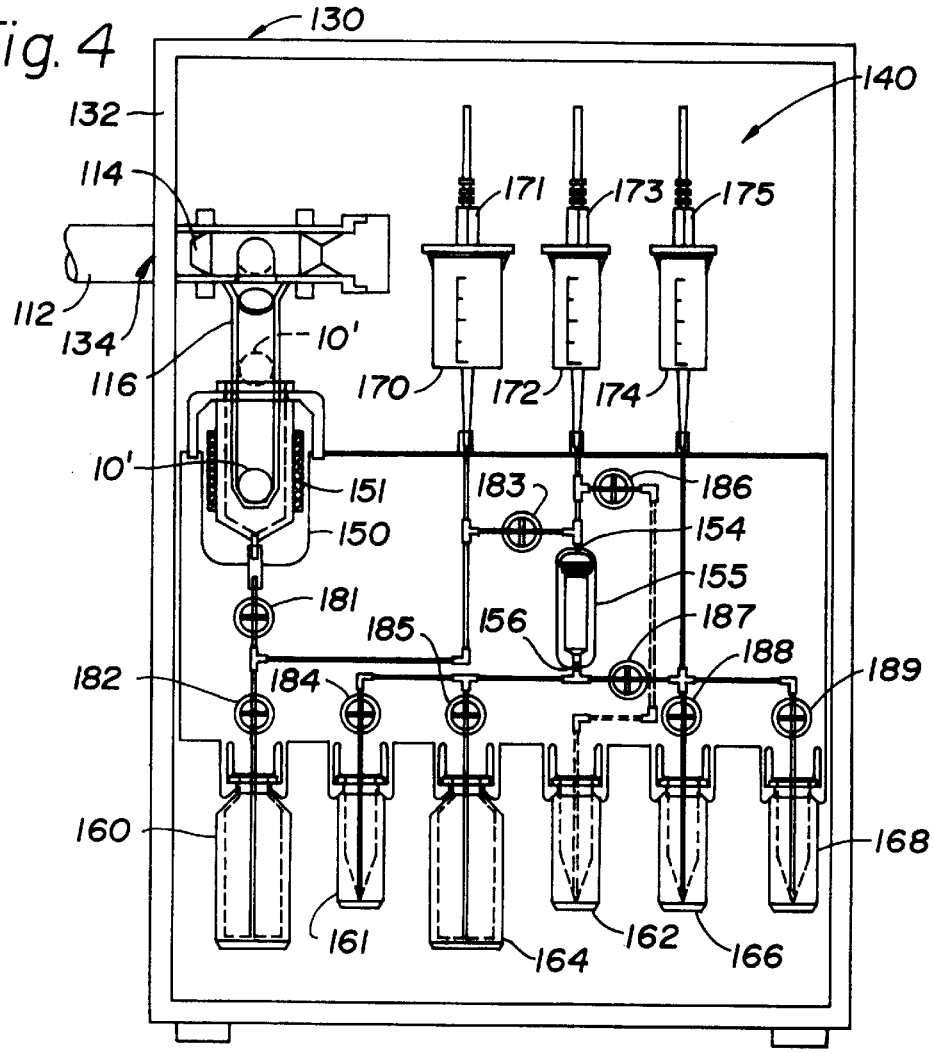
FIG. 4 is a schematic view of a preferred separation system of the present invention for separating $^{64}$Cu from unreacted $^{64}$Ni target material and from other radionuclides.

Regardless of the seat 54, 74 from which the irradiated target 10' is released, the irradiated target 10' is transferred out of the target holder 30. While such transfer can occur, for example, using robotics and/or a train-like conveyance system, the irradiated target is, after release, preferably transferred simply by free-fall under gravitational forces to an automatic pneumatic or hydraulic conveyor system for conveyance out of or within the accelerator vault for further processing. The irradiated target 10' is preferably transferred and conveyed in its own free form, without transporting additional target-supporting hardware such as chucks or other target-holder subassemblies. Transferring and conveying only the irradiated target 10' simplifies subsequent processing steps: no human intervention is required to separate the irradiated target 10' from a target holder chuck or other holding piece. The exact points of origination and destination served by the hydraulic or pneumatic conveyance system are not narrowly critical. The irradiated target is preferably conveyed from the target holder (FIG. 3E) directly to an automated separation system (FIG. 4). However, the pneumatic or hydraulic conveyance system could be combined with other transfer, conveyance systems and/or separation systems (e.g. robotic transfer systems, train conveyance systems, semi-automatic separation systems, etc.) as necessitated by the particular target holder and/or other circumstances.

A pneumatic or hydraulic conveyance system generally includes a transfer fluid moving through a directed space defined by transfer pipes, tubes and/or hoses, generally referred to herein as transfer lines. A pneumatic conveyance system includes the use of air or other gaseous fluids (e.g. nitrogen) to facilitate movement of the irradiated target 10' through a transfer line; whereas a hydraulic conveyance system includes the use of water or other liquid fluids to facilitate such movement. A pneumatic system is generally preferred over a hydraulic system in view of the potential for contaminating the liquid hydraulic fluid; however, the hydraulic fluid may be preferred for certain systems in which long-distance conveyance is required or in which the irradiated target 10' is particularly susceptible to damage during conveyance. While the description set forth below relates to a pneumatic conveyance system, it is to be considered relevant and instructive for a hydraulic system, as well.

Referring to FIGS. 3E and 4, after release from the target holder 30, the irradiated target 10' can drop through a guidance funnel 110 into a transfer line 112 (FIG. 3E) or, alternatively, into a transfer capsule (or "rabbit) 114 designed to receive the irradiated target 10' and to move within the transfer line 112 (FIG. 4). The transfer line 112 can be a pipe, tube, hose, or other space through which a pneumatic or hydraulic fluid can be directed. While the transfer line 112 preferably has a smooth interior surface, lines having corrugated surfaces such as ordinary vacuum hose may also be suitable. An irradiated target 10' is preferably conveyed through the transfer line 112 by itself, without being housed in a transfer capsule 114, such that the transfer fluid contacts the irradiated target directly. Conveying the irradiated target without a capsule substantially simplifies the mechanical apparatus and methods necessary to remotely transfer the target from a target holder to the conveyance system, and, after conveying the target, to remotely transfer the target from the conveyance system to a separation system. Moreover, for successive transfer of a plurality of targets, it is not necessary to provide for the return of the transfer capsule to the target holder for subsequent loadings. Despite these advantages, target materials and/or systems other than $^{64}Cu$ which are more sensitive to physical damage and/or to contamination may be preferably conveyed using a capsule 114.

To effect transfer of the irradiated target 10' within the transfer line 112, the pneumatic conveyance system includes a motive force means such as a vacuum source, fan or blower for effecting fluid movement within the transfer line 112. A corresponding hydraulic system can include a pump such as a centrifugal or positive displacement pump. In the case where the irradiated target is in contact with the fluid (ie, is being conveyed without using a transfer capsule), pneumatic or hydraulic transfer of the irradiated target is effected predominantly by the drag force of the transfer fluid on the irradiated target, whereby the irradiated target becomes entrained in the moving fluid. Where the target is conveyed while being housed in a transfer capsule, transfer of the capsule is predominantly effected by the pressure of the moving fluid against an end surface of the capsule. The motive force (e.g. vacuum, fan, pump, etc.) can be appropriately sized for the particular application of the conveyance system and depending on the required pressure head. In a preferred embodiment in which a gold disc-shaped substrate (about 2 cm in diameter and about 1 mm thick) having an irradiated target layer is being conveyed alone through a corrugated vacuum hose, the motive force can be provided by a wet/dry vacuum having a 3 hp motor and being capable of providing an air movement of about 100 $ft^3$/min (about 2.83 $m^3$/min) of air movement with a static pressure of about 100 inches $H_2O$ (about $2.49\times10^4$ Pa).

After being conveyed, the irradiated target 10' is preferably transferred to a separation system to separate the radionuclide of interest from other radioisotopes, from other radionuclides formed via side reactions, from unreacted target material, and if necessary, from substrate materials and/or impurities. While the irradiated target 10' can be discharged from the pneumatic conveyance system by any appropriate system (e.g. robotics, etc.) the target is preferably discharged by dropping via gravitational force from the transfer line 112 or from a rabbit 114 within the transfer line. Transfer and conveyance of the irradiated target 10' from the target holder 30 to a separation system are thereby effected remotely and automatically without human intervention.

The separation system is also preferably automated and designed for remote separation of the radionuclide of interest. Referring to FIG. 4, a preferred separation system includes a shielded separation unit 130 having a shielded housing 132, a mechanism 134 for effecting transfer of the irradiated-target 10' to the separation system and a disposable separation board or card 140. While the specific components of the disposable separation card 140 will vary depending on the target design and the chemistry of the separation, the separation card can generally include the following components arranged to facilitate the automatic and remote separation of the radionuclide of interest: one or more fluid containers such as cleaning vessels, dissolution vessels, reactant reservoirs, reaction vessels, discard/waste reservoirs, product vials, etc., one or more separation components such as an ion-exchange column, one or more pipetters in isolable fluid communication with the containers and/or separation components, tubing and remotely isolable valves or other means for isolable fluid communication between the components of the disposable separation card 140. The pipetters have a sealed plunger for effecting a transfer of liquids, for example, from a reactant reservoir to a dissolution vessel. The pipetters may also be used for agitating liquids contained within any of the vessels, vials or reservoirs by moving the pipetter plungers up and down in a continuous and alternating manner. The vessels, vials and/or reservoirs can be heated. The use of a disposable card minimizes impurities and thereby further improves the specific activity of the radionuclide.

In the $^{64}$Ni/64Cu system, the radionuclidic purity of the accelerator produced $^{64}$Cu is dependent upon the isotopic composition of the target material and the energy of the charged-particle beam. Table 5 (Example 4) lists the radionuclides which are formed in significant quantities from the proton bombardment of nickel and which are not separated during subsequent separation protocols. The proton irradiation of 95% enriched $^{64}$Ni at 15.5 MeV for a short period of time relative to the radionuclide half-lives results in the following detectable radionuclidic impurities at the end of bombardment: $^{55}$Co (about 0.16% yield relative to the yield of $^{64}$Cu) ($^{60}$Cu (about 27% relative yield), $^{61}$Cu (about 0.35% relative yield). (Table 6, Example 4). Nickel isotopes such as $^{57}$Ni are also produced, but are separated from the copper fractions during subsequent separation. The yield of $^{55}$Co relative to the yield of $^{64}$Cu after production runs and after separation of $^{64}$Cu from nickel ranged from about 0.01% to about 0.04%. Traces ($<10^{-4}$%) of other cobalt isotopes such as $^{56}$Co, $^{57}$Co and $^{58}$Co were also observed.

$^{64}$Cu is preferably separated from the gold substrate, from unreacted $^{64}$Ni target material, from $^{57}$Ni and, if desired, from $^{55}$Co using a separation card 140 such as is depicted in FIG. 4. The separation card can be reuseable or disposable. Ion-exchange methods can be used to separate $^{64}$Cu from $^{64}$Ni and $^{57}$Ni, and $^{64}$Cu and $^{61}$Cu can be allowed to decay. (Example 3).

A separation card 140 for use in separating copper and nickel preferably includes a first pipetter 170 in isolable fluid communication with a dissolution vessel 150, a HCl reservoir 160 and an anion-exchange column 155 having an inlet 154. The dissolution vessel 150 is equipped with a heater 151, and can be included a part of the disposable separation card 140, or alternatively, can be a permanent part of the reusable separation unit 130. A second pipetter 172 is in isolable fluid communication with the inlet 154 of the anion-exchange column 155 and with a deionized water reservoir 162. A third pipetter 174 is in isolable fluid communication with an outlet 156 of the anion-exchange column 155 and with discard reservoir 161, $^{64}$Ni vial 164, $^{64}$Cu vial 166 and dose vial 168. The pipetters 170, 172, 174 each comprise a plunger (not shown) driven by linear actuators 171, 173, 175, respectively. While the pipetters are preferably disposable, the actuators are preferably part of the reusable separation system. Fluid communication between the various card components can be provided via tubing. Components may be automatically and remotely isolated from each other by solenoid or pneumatically operated pinch valves 181, 182, 183, 184, 185, 186, 187, 188 and 189 or by other equivalently suitable types of valves. The valves can be included as a part of the disposable separation card 140, or alternatively, can be a permanent part of the reusable separation unit 130. A preferred sequence for the remote and automated control of the valves and plungers is summarized in Table 1 and detailed below.

TABLE 1

CONTROL SEQUENCE FOR AUTOMATED SEPARATION SYSTEM

| | Valves | | | | | | | | | Pipetters | | | |
|---|---|---|---|---|---|---|---|---|---|---|---|---|---|
| Step | 181 | 182 | 183 | 184 | 185 | 186 | 187 | 188 | 189 | 1 | 2 | 3 | Description of Step |
| 0 | ○ | ○ | ○ | ○ | ○ | ○ | ○ | ○ | ○ | ↓ | ↓ | ↓ | Starting state. |
| 1 | x | ○ | x | ○ | ○ | ○ | ○ | ○ | ○ | ↑ | ↓ | ↓ | Draw HCI from reservoir into P1. |
| 2 | ○ | x | x | ○ | ○ | ○ | ○ | ○ | ○ | ↓ | ↓ | ↓ | Fill dissolution vessel. |
| 3 | ○ | x | x | ○ | ○ | ○ | ○ | ○ | ○ | ↑↓ | ↓ | ↓ | Agitate and heat HCI in dissolution vessel. |
| 4 | x | ○ | x | ○ | ○ | ○ | ○ | ○ | ○ | ↑ | ↓ | ↓ | Draw HCI from reservoir into P1. |
| 5 | x | x | ○ | ○ | x | x | x | ○ | ○ | ↓ | ↓ | ↓ | Flush column with HCI, discard eluate. |
| 6 | ○ | x | x | ○ | x | x | x | ○ | ○ | ↑ | ↓ | ↓ | Draw Ni solution into P1. |
| 7 | x | x | ○ | x | ○ | x | x | ○ | ○ | ↓ | ↓ | ↓ | Elute column with Ni solution. |
| 8 | x | x | x | x | x | ○ | x | ○ | ○ | ↓ | ↑ | ↓ | Draw deionized water into P2. |
| 9 | x | ○ | x | x | x | x | ○ | ○ | x | ↓ | ↓ | ↓ | Elute column with deionized water. |
| 10 | x | x | x | x | x | x | x | ○ | x | ↓ | ↓ | ↑ | Draw $^{64}$Cu-solution into P3. |
| 11 | x | x | x | x | x | x | x | x | ○ | ↓ | ↓ | ↓ | Dispense $^{64}$Cu-solution. |

The irradiated target 10' can be cleaned, prior to dissolution, to insure it is free from contaminant copper prior to further processing. Such copper contamination may arise, for example, from contact of the substrate 12 with the cooling medium. The back of the substrate 12 may be cleaned, for example, by exposing the substrate in series to 1.0 N $HNO_3$, Milli-Q water, hexane and ethanol. While vessels for effecting such cleaning are not depicted in FIG. 4, such a method can be adapted to an automated system similar to the one described below. Alternatively, the target layer could be dissolved off the front face of the target, without submerging the contaminated backside of the substrate 12 in the dissolution solution.

Referring to FIG. 4, the target is preferably remotely exposed to an acidic solution in the dissolution vessel to dissolve the target layer off of the substrate, thereby resulting in a target-layer solution comprising $^{64}$Cu, $^{64}$Ni and other radionuclides. All valves are initially positioned to be open and each of the pipetter plungers are initially positioned in the down position. An irradiated target 10' is gravity-transferred from transfer line 112 to the dissolution vessel 150. The irradiated target 10' is exposed to HCl in the vessel 150. The dissolution vessel 150 containing the irradiated target or targets 10' is filled with HCl by drawing the HCl into the first pipetter 170 (by shutting valves 181 and 183 and effecting upward movement of its plunger), and then, after opening valve 181 and shutting valve 182, filling the vessel 150 with HCl by downward movement of the first-pipetter plunger. The HCl dissolves the target layer 16 off of the inert substrate 12 to form a $^{64}$Ni/$^{64}$Cu dissolution solution comprising the materials in the irradiated target layer. The HCl is preferably agitated by moving the first-pipetter plunger up and down and heated via heater 151 during dissolution.

Separation of nickel components from copper components in the dissolution solution is achieved by ion-exchange chromatography. (Example 3). The anion-exchange column 155 is prepared by drawing 6.0 M HCl into pipetter 170 (by shutting valves 181 and 183, opening valve 182 and effecting upward movement of first-pipetter plunger) and then flushing with the HCl and discarding the eluate (by shutting valves 182, 185, 186 and 187, opening valve 183 and effecting downward motion of the first-pipetter plunger). The $^{64}$Ni/$^{4}$Cu dissolution solution is drawn into the first pipetter 170 by opening valve 181, shutting valve 183 and effecting upward movement of the first-pipetter plunger. To obtain the nickel fraction, the target-layer solution is eluted through (i.e. passed over) the column 155 and a first eluate being substantially enriched in nickel relative to copper is collected in the $^{64}$Ni vial by shutting valves 181 and 184, opening valves 183 and 185, and effecting downward movement of the first-pipetter plunger. The copper fraction can be obtained by eluting with water, preferably with Milli-Q water, or with 0.5 M HCl to obtain a second eluate which is substantially enriched in $^{64}$Cu relative to other radionuclides or impurities. Deionized water is drawn into the second pipetter 172 (by shutting valves 183 and 185, opening valve 186 and effecting upward movement of the second-pipetter plunger), and passed over the column 155 for collection into the $^{64}$Cu vial (by shutting valves 186 and 189, opening valve 187, and effecting downward movement of the second-pipetter plunger). Analysis of the $^{64}$Cu fraction for specific activity and radionuclidic purity demonstrates that the production of $^{64}$Cu and other radionuclides by the methods presented herein is commercially attractive. (Example 4).

During the procedure detailed above for separation of copper from the nickel isotopes, $^{55}$Co partially separates with the copper fraction and partially with the nickel fraction. While not narrowly critical for purposes of preparing $^{64}$Cu radiopharmaceuticals according to the present invention, it is possible to obtain a more complete separation of $^{55}$Co from $^{64}$Cu. (Maziere et al., 1983).

The $^{64}$Cu solution may be dispensed for preparation of labeling compounds that are useful as diagnostic and therapeutic radiopharmaceutical compounds. The $^{64}$Cu solution is preferably dispensed by drawing the solution into the third pipetter 174 and then dispensing to the dose vial 168. Specifically, the solution is draw into the third pipetter 174 by shutting valve 187 and effecting upward movement of the third-pipetter plunger. Dispensing to the dose vial 168 is effected by shutting valve 188, opening valve 189 and effecting downward movement of the third-pipetter plunger. The accelerator-produced $^{64}$Cu was equivalent to or better than reactor-produced $^{64}$Cu for the preparation of $^{64}$Cu radiopharmaceuticals. (Example 6).

The unreacted target material can be recycled for use in another target. In the $^{64}$Ni/$^{64}$Cu system, $^{64}$Ni can be recycled and used to prepare new targets by a procedure in which the $^{64}$Ni solution resulting from the separation process described above is used to form a new $^{64}$Ni electrolytic solution. (Example 5). The recycling of $^{64}$Ni solution to form new targets further improves the purity of the target layer, since any copper impurities are removed during the preceding separation steps. As such, each subsequent production run using targets having target layers comprising the recycled $^{64}$Ni material will result in even higher specific activities than the preceding runs.

The following examples illustrate the principles and advantages of the invention.

EXAMPLES

High purity reagents used in the electroplating and separation experiments (99.999999% HCl, 99.9999% $HNO_3$, 99.9999% $H_2SO_4$) were purchased from Alfa Aesar (Ward Hill, Mass.). Ammonium hydroxide (>99.99%) and TETA (1,4,8,11-tetraazacyclotetradecane-1,4,8,11-tetraacetic acid) were purchased from Aldrich Chemical Company Milwaukee, Wis. Isotopically enriched Ni-64 (95%) was bought from Cambridge Isotope Laboratories, Andover, Mass. Enriched Ni-64 (98%) was purchased from Trace Sciences International, Richmond Hills, Ontario, Canada. Gold disks (1.9 cm diameter×0.15 cm thickness, 5N purity) were obtained from Electronic Space Products International, Ashland, Oreg. Gold foils (99.99%, 100 $\mu$m thick, were purchased from Aldrich Chemical Company, Milwaukee, Wis. Graphite rods (0.3 cm diameter) were bought from Bay Carbon (Bay City, Mich.). Xpertek brand silica plates were purchased from P J Cobert (St. Louis, Mo.). Buffer salts (ammonium acetate and ammonium citrate) were obtained from Fluka Chemical Company, Ronkonkoma, NY. Ammonium sulfate (99.999%) was purchased from Aldrich Chemical Company, Milwaukee, Wis. Ion exchange resin (AG1-X8) and Biospin gel filtration columns were purchased from BioRad (Hercules, Calif.). C-18 SepPak light cartridges were purchased from Millipore, Marlborough, Mass. Sephadex G 25-50 was purchased from Sigma (St. Louis, Mo.).

EXAMPLE 1

TARGET PREPARATION

To form a target, $^{64}$Ni was deposited on a gold substrate using an electrolytic cell configured as shown in FIGS. 2A and 2B. A Pyrex tube (1.3 cm diameter, 8.6 cm length) was used as a reservoir for containing the electrolytic solution by sealing one end to a target substrate held on a support plate. Interchangeable Teflon spacers allowed for deposition into either a 1.38 cm or 0.5 cm diameter circle. Gold disk or foil substrates were used because subsequent processing of the target required that the substrate be resistant to dissolution in concentrated HCl. The anode was a 0.3 cm diameter graphite rod mounted in the center of the cell. A miniature motor was used to rotate the rod at about 100 rpm during electrodeposition. This served to agitate the solution and maintain a flow of fresh electrolyte to the substrate surface.

Appropriate quantities of nickel metal were dissolved in 6.0 M nitric acid and evaporated to dryness. The residue was treated with concentrated sulfuric acid, diluted with deionized water, and evaporated to almost dryness. The residue was cooled and diluted with deionized water. The pH was then adjusted to 9 with concentrated ammonium hydroxide and ammonium sulfate electrolyte was added (0.1–0.5 g). The final volume of the solution was adjusted to approximately 10 mL with deionized water. This solution was transferred to the cells and used for electroplating. The cells were typically operated at 2.4–2.6 volts and at currents between 10–50 mA. Electroplating was accomplished in 12–24 hours. Either gold foils or gold disks were used as cathodes and graphite rods were used as anodes in the electroplating experiments. The anode was rotated at about 100 rpm during electrodeposition.

Nickel target layers having of thicknesses ranging from about 20 $\mu$m to about 300 $\mu$m (at 0.5 and 1.38 cm diameter) were electroplated onto gold substrates, as summarized in Table 2 (Ex. 2) and Table 3 (Ex. 2). Initial experiments were performed using 95% enriched Ni-64 at 1.38 cm plating diameter, with plating efficiencies of 98–100%. Plating efficiency is defined as the ratio of the mass of the electroplated nickel to the initial mass of nickel in solution. A beam profile, measured using autoradiography, showed that over 90% of the beam current was contained within 0.5 cm diameter central core. Plating and irradiation experiments were then performed on Ni-64 plated at 0.5 cm diameter with a plating efficiency of 96–97%. Reducing the plating diameter to create a target area which matched the beam impingement area reduced the amount of the costly Ni-64 required for an optimal thickness target. This reduced the cost of the $^{64}$Cu production, and also increased the specific activity since the target material itself is a source of contaminant copper.

EXAMPLE 2

$^{64}$Cu PRODUCTION

Copper-64 was produced by the $^{64}$Ni(p,n) Cu nuclear reaction by irradiating a $^{64}$Ni target with protons at beam energies of 15.5 MeV, 11.4 MeV or 4.1 MeV. Irradiation experiments at 15.5 MeV and 11.4 MeV proton beam energies were performed using a Cyclotron Corporation CS-15 cyclotron at Washington University, St. Louis. This accelerator is capable of delivering external beams of up to approximately 60 microamps of 15.5 MeV protons. The 11.4 MeV beam was generated from the CS-15 15.5 MeV beam degraded with 125 $\mu$m thick gold foil. Irradiations at 4.1 MeV proton beam energy were performed using the Van de Graaff accelerator at the University of Massachusetts at Lowell. Cu-64 yields were determined using a calibrated Ge detector (Canberra Model 1510, Meriden, Conn.)) or a Ge detector in combination with a radioisotope dose calibrator (Capintec CRC-10, Pittsburgh, Pa.).

For the Cu-64 production experiments at 15.5 MeV, enriched $^{64}$Ni (98% and 95%) targets were irradiated at currents ranging from about 15 $\mu$A to about 45 $\mu$A. For the experiments carried out using 11.4 MeV, natural nickel targets were irradiated. The results were extrapolated to 95% enrichment. For the Cu-64 experiments carried out at 4.1 MeV proton beam energies, a 95% enriched $^{64}$Ni target was used. The appearance of the target was, in most cases, unchanged after irradiation, indicating that the temperature of the nickel layer was maintained below its melting point.

The results of the $^{64}$Cu production runs at 15.5 MeV proton energy are summarized in Table 2. An initial production run at 15.5 MeV was carried out using a target having a 311 $\mu$m thick target layer (54.4 mg $^{64}$Ni plated in a 0.5 cm diameter). This run yielded approximately 600 mCi of Cu-64 with a production yield of 5.0 mCi/$\mu$Ah. To increase yields, beam alignment was optimized by placing a collimating aperture (0.5 cm) in the cyclotron beam path upstream of the target holder immediately downstream of the beam housing. Beam alignment was verified using a plexiglass witness plate at the target position. The plexiglass was irradiated for very short times at low beam current and visually inspected to determine the beamstrike position. The beam position was then adjusted accordingly. Subsequent $^{64}$Cu production runs gave yields which were in good agreement with predicted yields.

The results of the $^{64}$Cu production runs at 11.4 MeV and 4.1 MeV proton energy are summarized in Table 3. Two production runs at 11.4 MeV were carried out using a target having a 113 $\mu$m thick target layer (150 mg $^{nat}$Ni plated in a 1.38 cm diameter). These runs resulted in production yields of 2.3 and 3.0 mCi/$\mu$Ah. One production run at 4.1 MeV was carried out using a target having a 20 $\mu$m thick target layer (26.9 mg $^{64}$Ni plated in a 1.38 cm diameter). This run resulted in a production yield of about 0.1 mCi/$\mu$Ah.

TABLE 2

PRODUCTION RUNS OF Cu-64 AT 15.5 MeV

| sample ID | Ni-64 (mg)$^{+}$ | Bombardment condition (mA*hr) | Thickness ($\mu$m) | EOB mCi Cu-64 | EOB mCi/$\mu$A *hrs | Pre-dicted EOB mCi/$\mu$A *hrs$^{++}$ | Specific acitivity (TETA Titration) mCi/$\mu$g Cu |
|---|---|---|---|---|---|---|---|
| 253 | 54.4 | 120 | 311 | 600 | 5.0 | 10.5 | 122 (7808 Ci/mmol) |
| 265 | 23 | 66 | 132 | 150 | 2.28 | 3.5 | 249 (15,936 Ci/mmol) |
| 275 | 21 | 72 | 120 | 240 | 3.30 | 3.3 | 216 (13,824 Ci/mmol) |
| 281 | 18.7 | 75 | 107 | 250 | 3.33 | 3.0 | 190 (12,160 Ci/mmol) |
| 289 | 23.2 | 139 | 133 | 500 | 3.6 | 3.5 | 310.2 (19,840 Ci/mmol) |
| 293 | 23.7 | 69 | 136 | 280 | 4.03 | 3.7 | >94 (6016 Ci/mmol) |

TABLE 2-continued

PRODUCTION RUNS OF Cu-64 AT 15.5 MeV

| sample ID | Ni-64 (mg)+ | Bombardment condition (mA*hr) | Thickness (μm) | EOB mCi Cu-64 | EOB mCi/μA *hrs | Pre-dicted EOB mCi/μA *hrs++ | Specific acitivity (TETA Titration) mCi/μg Cu |
|---|---|---|---|---|---|---|---|
| 285 | 21.5 | 70 | 123 | 260 | 3.74 | 3.4 | 103 (6592 Ci/mmol) |
| MB3 | 18.4 | 53 | 105 | 118 | 2.24 | 2.7 | 100–230 (6400–14,270 Ci/mmol) |
| MB13 | 20.1 | 62 | 115 | 180 | 2.9 | 3.2 | 264 (16896 Ci/mmol) |

++Theoretical yields as predicted

+Target samples 253, 265, 275 and 281 each had target layers comprising 95% enriched $^{64}$Ni, whereas target samples 289, 293, 285, MB3 and MB13 each had target layers comprising 98% enriched $^{64}$Ni. All targets had a plated diameter of 0.5 cm.

TABLE 3

Cu-64 PRODUCTION AT 11.4 AND 4.1 MeV

| sample ID | Proton energy (MeV) | Ni (mg)+ | thickness (μm) | measured yield (mCi/μA *hrs) | Predicted yield (mCi/μA *hrs) |
|---|---|---|---|---|---|
| W621-1 | 11.4 | 150 | 113 | 2.3 | 4.5[a] |
| W621-2 | 11.4 | 150 | 113 | 3.0 | 4.5[a] |
| L706-1 | 4.1 | 26.9 | 20 | 0.096 | 0.088[b] |

[a]Yields at 11.4 MeV.

[b]Yields at 4.1 MeV.

+All targets had a plated diameter of 1.38 cm.

These experiments demonstrate that useful isotope yields can be produced at all three beam energies. A three hour bombardment at 45 μA will produce over 1 Ci of activity at 15–16 MeV and over 400 mCi at 11–12 MeV. A low energy, high current linear accelerator (operating at 4.1 MeV, 500 μA for example) could produce over 140 mCi of $^{64}$Cu activity in a three hour bombardment.

EXAMPLE 3

SEPARATION OF $^{64}$Cu FROM $^{64}$Ni

Figure 5:
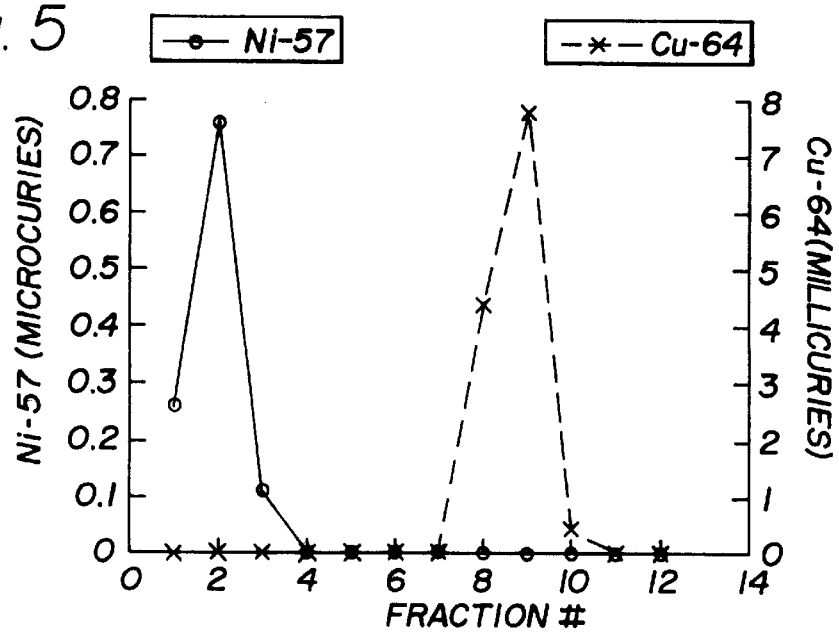
FIG. 5 is a graph depicting the separation profile for an irradiated sample solution and showing sequential elution of nickel and copper.

After irradiation, the Cu-64 was separated from the target nickel and other contaminants using an ion exchange column. The irradiated $^{64}$Ni was dissolved off the gold disk in 10 mL of 6.0 N hydrochloric acid heated to 90° C. The resulting $^{64}$Ni/$^{64}$Cu solution was then evaporated to dryness. The residue was dissolved in 3.0 ml of 6.0 N HCl. In subsequent experiments, the $^{64}$Ni was initially dissolved in 3.0 ml of 6.0 N HCl under reflux conditions without subsequent drying and redissolution. In both cases, the resulting solution was eluted through a 4×1 cm BioRad AG1-X8 anion exchange column (treated with 6.0 N HCl prior to use). The nickel fraction, containing both $^{57}$Ni and $^{64}$Ni, was eluted in the first 15 mL of 6.0 N HCl. Upon switching to deionized water (or 0.5 M HCl), the copper was immediately eluted in the first 8–10 Ml. A typical separation profile is shown in FIG. 5.

Figure 6:
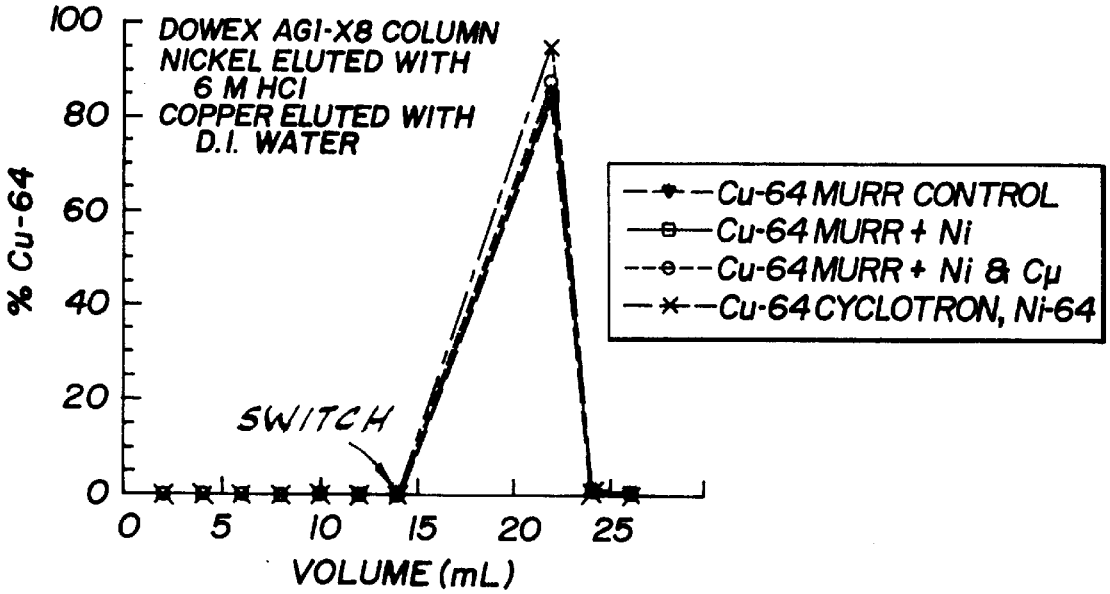
FIG. 6 is a graph depicting the separation profile for several irradiated sample solutions showing elution of copper and demonstrating the minimal effect of carrier copper on the separation of $^{64}$Cu from $^{64}$Ni target material.

To determine the effect of carrier copper and nickel on the separation, four identical columns of BioRad AG1-X8 of 4×1.1 cm were used to separate copper from up to 100 mg Ni. The columns were initially treated with 6M Hcl prior to the separation. The following mixtures were added to these columns and eluted: a) purified $^{64}$Cu from MURR in 6M Hcl; b) purified $^{64}$Cu from MURR to which 30 mg of natural nickel had been added; c) purified $^{64}$Cu from MURR to which 30 mg of natural nickel and 4 μg of carrier copper had been added; and d) 28 mg of enriched $^{64}$Ni irradiated with the cyclotron. The enriched $^{64}$Ni (95%) used as the target for case (d) contained 180 ppm carrier copper as an impurity—equivalent to ~4 μg in a 30 mg target sample. Hcl was passed through the columns to elute the nickel, with eight 2 ml fractions of eluate being collected. A switch to distilled water immediately eluted the copper. FIG. 6 shows the chromatographic profiles of the four column runs (a–d). The results demonstrate that the addition of the nickel and carrier copper does not affect separation.

An additional study (case e) was performed using a target wherein the target layer was prepared from $^{64}$Ni that had been recycled after one irradiation (Ex.5). To separate $^{55}$Co from $^{64}$Cu, a BioRad AG1-X8 equivalent in size to those used for the separation of copper and nickel above was used with the same eluates being collected in 2 ml fractions. The resulting profiles of $^{64}$Cu and $^{55}$Co (not shown) demonstrate that the $^{55}$Co elutes partially with the copper fraction and partially with the nickel fraction. While the isotopic purity of $^{64}$Cu is only partially enhanced with respect to $^{55}$Co using the preferred separation protocol set forth herein, the relatively small yield of $^{55}$Co was not of significant concern for the radiopharmaceutical applications which were considered.

EXAMPLE 4

DETERMINATION OF SPECIFIC ACTIVITY AND RADIONUCLIDIC PURITY OF $^{64}$Cu

Figure 7:
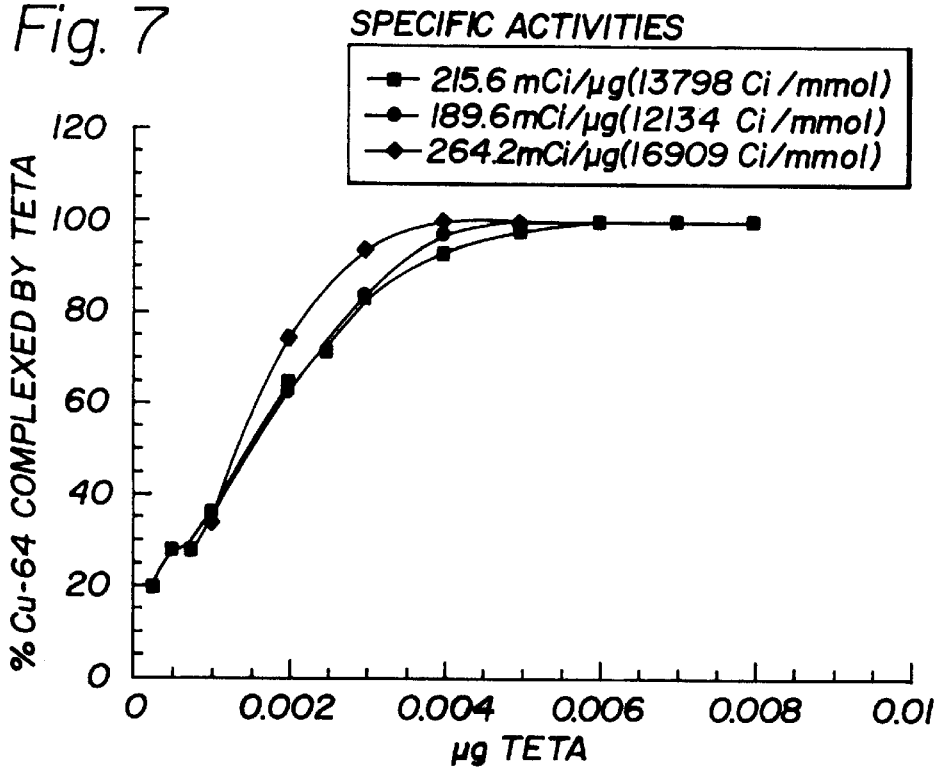
FIG. 7 is a graph depicting the specific activity titrations of $^{64}$Cu with TETA.

The specific activity (mCi/μg) of the cyclotron produced Cu-64 was determined experimentally via titration of $^{64}$Cu $(OAc)_2$ with the macrocycle TETA. 100% complexation occurs at a 1:1 mole ratio of Cu to TETA. Aliquots of TETA were added to $^{64}$Cu$(OAc)_2$ and the percent complexation ($^{64}$Cu-TETA) was monitored by radio TLC (Bioscan, Washington, D.C.). In a typical experiment, 30 μL aliquots of 70–100 μCi (decay corrected to the end of bombardment-EOB) of the $Cu(OAc)_2$ solution were added to each reaction vessel. The pH (5.5) and volume (125 μL) were kept constant using 0.1 M $NH_4OAc$ buffer. Various volumes of stock TETA solutions ($2\times10^{-4}$M to $2\times10^{-1}$M) were added and the samples were vortexed and incubated at 35 ° C. for 60 minutes. Samples were spotted on silica plates and the plates developed using 1:1 MeOH:10% $NH_4OAc$. $Cu(OAc)_2$ remained at the origin whereas complexed copper in the form of $Cu(TETA)^{2-}$ migrated with $R_f$=0.42. The minimum TETA concentration where 100% labeling occurred was assumed to be equal to the concentration of Cu(II) present. Typical titration plots are shown in FIG. 7.

The specific activities of the $^{64}$Cu produced from the 15.5 MeV proton energy irradiation experiments range from about 94 mCi/μg Cu to about 310 mCi/μg Cu, as summarized in Table 2. (Ex. 2). For comparison purposes, the specific activity for $^{64}$Cu produced at MURR was determined (about 100 mCi/$\mu$g Cu). Hence, the specific activity of cyclotron-produced $^{64}$Cu compares favorably to the reactor-produced $^{64}$Cu, and as such, is sufficiently high for the diagnostic and therapeutic radiopharmaceutical applications which are presently using reactor-produced $^{64}$Cu.

In separate experiments, the $^{64}$Cu fractions from comparative separation cases a–e (Ex. 3) were analyzed for carrier copper concentrations by ion chromatography. This method allowed the calculation of the total amount of copper in the sample. The results are tabulated in Table 4.

TABLE 4

STABLE COPPER IN $^{64}$Cu AS DETERMINED BY ION CHROMATOGRAPHY

| Sample (Source and Content) | mg Copper in sample |
|---|---|
| (a) MURR Cu-64 Control | 0.22 |
| (b) MURR Cu-64 + Ni | 0.89 |
| (c) MURR Cu-64 + Ni + carrier Cu | 4.10 |
| (d) Cyclotron Cu-64 (enriched Ni-64) | 3.34 |
| (e) Cyclotron Cu-64 (recycled Ni-64) | 1.37 |

Based on this data, samples (c) and (d) contain approximately equal amounts of copper. In sample (c), 4 $\mu$g of carrier copper was added, whereas for sample (d), the copper was present as an impurity in the $^{64}$Ni supplied by the manufacturer. Recycling the $^{64}$Ni reduced the carrier copper to 1.37 $\mu$g (40% of the original). Thus, it is possible to purify the $^{64}$Ni target material, and result in higher specific activities, through one or more repeated recycling processes. The carrier copper contained in the control samples presumably originated from the reagents used, including the ion exchange resin.

The radionuclidic impurities were determined using the calibrated Ge detector. Table 5 lists the other radionuclides which are formed in significant quantities from the proton bombardment of nickel. The production of $^{57}$Ni was not of concern since it was separated from the copper activity with the nickel target material.

Table 6 shows the relative quantities of the non-nickel radionuclide impurities produced at proton beam energies of 15.5 MeV, 11.4 MeV, and 4.1 MeV, and demonstrates that the radioisotopic purity of the $^{64}$Cu produced by cyclotron irradiation of $^{64}$Ni is very high, even at the end of bombardment (EOB). For natural nickel irradiated at 15.5 MeV and 11.4 MeV, the radionuclidic yields were scaled to 95% enriched $^{64}$Ni. The irradiations times were relatively short (5–6 minutes) as compared to the half-lives of all the listed radionuclides. The experiment at 4.1 MeV used 95% enriched $^{64}$Ni and a one hour irradiation. At this energy, $^{60}$Cu was not produced. As noted above, $^{55}$Co can be partially separated using ion exchange methods (Ex. 3). The $^{60}$Cu and $^{61}$Cu activities are of little consequence because of their relatively short half-lives as compared with that of $^{64}$Cu.

TABLE 5

RADIONUCLIDES FORMED BY PROTON IRRADIATION OF NICKEL ISOTOPES

| Radionuclide | Half-life | Nuclear Reaction | Q-value |
|---|---|---|---|
| $^{60}$Cu | 24 min. | $^{60}$Ni(p,n)$^{60}$Cu | −6.93 MeV |
| $^{61}$Cu | 3.32 hr | $^{61}$Ni(p,n)$^{61}$Cu | −3.01 MeV |
| $^{64}$Cu | 12.7 hr | $^{64}$Ni(p,n)$^{64}$Cu | −2.46 MeV |

TABLE 5-continued

RADIONUCLIDES FORMED BY PROTON IRRADIATION OF NICKEL ISOTOPES

| Radionuclide | Half-life | Nuclear Reaction | Q-value |
|---|---|---|---|
| $^{55}$Co | 18.2 hr | $^{58}$Ni(p,a)$^{55}$Co | −1.35 MeV |
| $^{57}$Ni | 36 hr | $^{58}$Ni(p,d)$^{57}$Ni | −9.7 MeV |

TABLE 6

MEASURED RELATIVE YIELDS AT EOB FOR 95% ENRICHED $^{64}$Ni$^{+}$

| Radionuclide | Relative yield at 15.5 MeV | Relative yield at 11.4 MeV | Relative yield at 4.1 MeV |
|---|---|---|---|
| $^{60}$Cu | 0.27 | 0.12 | ND |
| $^{55}$Co | 0.0016 | 0.00019 | ND |
| $^{61}$Cu | 0.0035 | 0.0037 | ND |
| $^{64}$Cu | 1.0 | 1.0 | 1.0 |

$^{+}$Target thickness were 113 $\mu$m at 15.5 and 11.4 MeV and 20 $\mu$m at 4.1 MeV
*ND = not detectable

EXAMPLE 5

RECYCLING OF $^{64}$Ni TO FORM NEW TARGETS

After the ion-exchange column separation of $^{64}$Cu from nickel, the nickel fraction (collected in 6.0 M HCl) was evaporated to dryness, the residue treated with 6.0 M $HNO_3$, evaporated to dryness and then redissolved in ~10 mL 6.0 M $HNO_3$. The solution was again evaporated to dryness, and the residue treated with 1 mL concentrated $H_2SO_4$. The solution was diluted with deionized water and the pH was adjusted to 9 with concentrated $NH_4OH$. Ammonium sulfate was added to the solution, and the final volume was adjusted to 10 mL with deionized water. The solution was then quantitatively transferred to the electroplating cells and electroplating was carried out as described. By employing this method for 20 mg targets, 90.5±4.0% (n=5) of the nickel-64 has been recovered and used for subsequent production runs and labeling experiments.

In an alternative approach for recycling the $^{64}$Ni, several experiments were carried out wherein the nickel was precipitated as nickel dimethylglyoxime. 100 mg of nickel was dissolved in 5 ml of 6M HCl and the sample eluted from a BioRad column as required for the copper separation. In order to evaluate the efficiency of separation, a small amount of MURR copper was added to the sample. The first 18 ml of the eluant was collected in one fraction and this fraction was utilized to recover nickel by precipitation with dimethylgloxime. The precipitate was weighed and dried and the amount of nickel dimethylglyoxime collected corresponded to approximately 99% recovery of the nickel metal.

EXAMPLE 6

PREPARATION OF $^{64}$Cu RADIOLABELED COMPOUNDS AND USE THEREOF IN DIAGNOSTIC AND THERAPEUTIC APPLICATIONS

Examples of compounds which can be radiolabeled with copper-64 are: 1) lipophilic copper chelates that can quantify blood flow; 2) monoclonal antibodies and antibody fragments that can be used in both diagnosis and therapy; and 3)

small peptides that can be used in both diagnosis and therapy. Upon purification from the Ni-64 target, Cu-64 was available in 8–10 mL of 0.5 M HCl. The HCl was removed by heating to dryness under nitrogen. The dried Cu-64 was then dissolved in 140 $\mu$L 0.1M HCl. $^{64}CuCl_2$ prepared in this manner was used in all labeling experiments.

$^{64}$Cu-labeled PTSM was prepared as follows: A small volume of $^{64}CuCl_2$ (1 mCi, 30 $\mu$L) was diluted to 2 mL with 0.4 M $NH_4OAc$, pH 5.5. $H_2PTSM$ (3 $\mu$g, 0.2 mL ethanol) was added to the $^{64}Cu(OAc)_2$ solution and incubated for a minimum of 2 minutes. This was purified on a C-18 SepPak column and eluted in 1.0 mL of ethanol. $^{64}$Cu-labeled TETA-octreotide was prepared as previously described. Briefly, $^{64}CuCl_2$ (1–175 mCi) was diluted to 0.25–1.0 mL with 0.1M $NH_4OAc$, pH 5.5. This was added to 1–50 $\mu$g TETA-octreotide (0.25–1.0 mL) in 0.1 M $NH_4OAc$, pH 5.5 and incubated for one hour at room temperature. Purification was accomplished using a C-18 SepPak light cartridge as previously described. $^{64}$Cu-labeled BAT-2IT-1A3 was prepared as previously described. Briefly, $^{64}CuCl_2$ (1–130 mCi) was added to 0.1 M ammonium citrate buffer, pH 5.5. $^{64}$Cu-citrate was added to BAT-2IT-1A3 in 0.1 M ammonium citrate, pH 5.5, and incubated for 30 minutes at room temperature. Uncomplexed $^{64}$Cu ($^{64}$Cu-citrate) was purified from $^{64}$Cu-BAT-2IT-1A3 using a centrifuged gel filtration column. Quality control was performed using fast protein liquid chromatography (FPLC, Pharmacia, Uppsala, Sweden) as previously described (Anderson et al, 1992).

The specific activity of $^{64}$Cu-TETA-octreotide and $^{64}$Cu-BAT-2IT-1A3 prepared using cyclotron produced $^{64}$Cu was directly correlated to the specific activity of the $^{64}CuCl_2$ produced on the cyclotron. The specific activity and radiochemical purity of several preparations of $^{64}$Cu-TETA-octreotide and $^{64}$Cu-BAT-2IT-1A3 made using this $^{64}CuCl_2$ are given in Table 7. The specific activity of the

TABLE 7

SPECIFIC ACTIVITY AND RADIOCHEMICAL PURITY OF $^{64}$Cu-TETA-OCTREOTIDE AND $^{64}$Cu-BAT-2IT-1A3 PREPARATIONS

| Sample ID | Compound | Specific Activity ($\mu$Ci/$\mu$g) day of radiopharmaceutical preparation* | Radiochemical Purity |
|---|---|---|---|
| 265 | $^{64}$Cu-TETA-octreotide | 979 (1466 Ci/mmol) | >90% |
| 281 | $^{64}$Cu-TETA-octreotide | 277 (415 Ci/mmol) | 95% |
| 289 | $^{64}$Cu-TETA-octreotide | 3407 (5104 Ci/mmol) | 90% |
| 289 | $^{64}$Cu-BAT-2IT-1A3 | 7.1 (1065 Ci/mmol) | 95% |
| 293 | $^{64}$Cu-TETA-octreotide | 2771 (4106 Ci/mmol) | 90% |
| 293 | $^{64}$Cu-BAT-2IT-1A3 | 8.4 (1260 Ci/mmol) | 100% |
| MB 3 | $^{64}$Cu-TETA-octreotide | 3382 (5066 Ci/mmol) | >90% |
| MB 3 | $^{64}$Cu-BAT-2IT-1A3 | 7.1 (1065 Ci/mmol) | 95% |

*Radiopharmaceuticals were prepared 4–48 hours after EOB labeled radiopharmaceuticals were lower than the specific activity determined for the $^{64}CuCl_2$ due to metal impurities inherent in the reagents used in the labeling. Nevertheless, the specific activities and purities using the cyclotron produced $^{64}$Cu were comparable to those obtained using MURR-produced $^{64}$Cu. Along with analyzing the cyclotron produced $^{64}$Cu radiopharmaceuticals for purity using chromatography methods, we also analyzed each radiopharmaceutical using a Ge detector for other radiometals such as $^{55}$Co. Ge spectra were performed on $^{64}$Cu-TETA-octreotide, $^{64}$Cu-TETA-1A3, and $^{64}$Cu-TETA. $^{64}$Cu-TETA-octreotide, $^{64}$Cu-TETA-1A3 showed no detectable amounts of $^{55}$Co. The presence of $^{55}$Co present in $^{64}$Cu-TETA, however, varied depending on the amount of TETA labeled. At the highest concentrations of TETA, where the ligand was in great excess, 0.16% $^{55}$Co was present, indicating that all $^{55}$Co present was labeled. This indicates that the ligand TETA preferentially labels $Cu^{2+}$over $Co^{2}$+, but when excess ligand is present, $^{55}$Co will not be purified from the $^{64}$Cu-labeled TETA-octreotide or TETA-1A3 conjugates. However, nearly all of the $^{55}$Co contaminant can be removed in the $^{64}$Cu separation procedure.

EXAMPLE 7

PRODUCTION OF OTHER RADIONUCLIDES

Other radioisotopes with potential for biomedical use can be produced using the methods and systems of the present invention. Experiments in which natural nickel (26.1% Ni-60 and 1.13% Ni-61) electroplated at various thicknesses were irradiated with protons at 15 MeV demonstrate that useful quantities of Cu-60 (via Ni-60(p,n)Cu-60 reaction) and Cu-61 (via Ni-61(p,n)Cu-61 reaction) can be produced. The reaction products were analyzed using a Ge (gamma) detector and the results are summarized in Table 8 and Table 9.

TABLE 8

PRODUCTION OF Cu-60 USING Ni-60

| thickness (mm) | amount of Cu-60 produced (mCi) | amount of Cu-60 produced (mCi/mAhr) | amount of Cu-60 produced (mCi/mAhr)* |
|---|---|---|---|
| 220 | 21 | 46.0 | 167 |
| 190 | 542 | 15.0 | 54.6 |
| 287** | 331 | 9.17 | 33.4 |

*extrapolated to 95% Ni-60
**0.5 cm diameter

TABLE 9

PRODUCTION OF Cu-61 USING Ni-61

| thickness (mm) | amount of Cu-61 produced (mCi) | amount of Cu-61 produced (mCi/mAhr) | amount of Cu-61 produced (mCi/mAhr)* |
|---|---|---|---|
| 220 | 0.2 | 0.44 | 37.0 |
| 190 | 7.9 | 0.22 | 18.5 |
| 287** | 5.0 | 0.14 | 11.6 |

*extrapolated to 95% Ni-61
**0.5 cm diameter

Other radionuclides can be produced using the systems and method described herein. Table 10 summarizes a variety of other possible targets, nuclear reactions, and resulting products to which the invention may be applied.

In light of the detailed description of the invention and the examples presented above, it can be appreciated that the several objects of the invention are achieved. The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention.

TABLE 10

PRODUCTION OF OTHER RADIONUCLIDES

| Target | Nuclear Reaction | Target Abundance | Product | Product Half-life and Major Decay |
|---|---|---|---|---|
| $^{43}$Ca | (p,n) | 0.145% | $^{43}$Sc | 3.92 h, β+ |
| $^{48}$Ca | (d,n) | 0.185% | $^{49}$Sc | 57 min, β− |
| $^{45}$Sc | (p,n) | 100% | $^{45}$Ti | 3.1 h, β+ |
| $^{48}$Ti | (p,n) | 74% | $^{48}$V | 16.0 d, β+, E.C. |
| $^{50}$Cr | (d,n) | 4.3% | $^{51}$Mn | 45 min, β+ |
| $^{54}$Fe | (d,n) | 5.84% | $^{55}$Co | 18.2 h, β+ |
| $^{70}$Zn | (p,α) | 0.62% | $^{67}$Cu | 58 h, β− |
| $^{66}$Zn | (p,n) | 27.8% | $^{66}$Ga | 9.5 h, β+ |
| $^{69}$Ga | (p,n) | 60% | $^{69}$Ge | 36 h, E.C. |
| $^{74}$Se | (d,n) | 0.9% | $^{75}$Br | 1.7 h, β+ |
| $^{84}$Sr | (d,n) | 0.56% | $^{85}$Y | 14.6 h, E.C. |
| $^{89}$Y | (p,n) | 100% | $^{89}$Zr | 78 h, E.C. |
| $^{90}$Zr | (p,n) | 51.5% | $^{90}$Nb | 14.6 h, β+ |
| $^{94}$Mo | (p,n) | 9.12% | $^{94m}$Tc | 5.3 min, β+ |
| $^{99}$Ru | (p,n) | 12.6% | $^{99}$Rh | 16 d, β+ |
| $^{124}$Te | (p,n) | 4.6% | $^{124}$I | 4.15 d, E.C. |

BIBLIOGRAPHY

Anderson et al. (abs) (1993) Comparison of Cu-67 and Cu-64 as Potential Radionuclides for Radiotherapy. *J. Nucl. Med.*, 34:134P.

Anderson et al. (1992) Copper-64-labeled Antibodies for PET Imaging. *J. Nucl. Med.*, 33:1685–91.

Anderson et al. (abs) (1994) Initial Comparison of Cu-64 and Cu-67-labeled Anticolorectal Carcinoma MAb 1A3 as Agents for Radioimunotherapy in Tumor-bearing Hamsters. *J. Nucl. Med.*, 35:161P.

Anderson et al. (abs) (1995a) In Vitro and In Vivo Evaluation of Copper-64-octreotide Conjugates. *J. Lab. Comp. Radiopharm.*, 35:359.

Anderson et al. (1995b) Preparation, Biodistribution and Dosimetry of Copper-64-labeled Anti-colorectal Carcinoma Monoclonal Antibody Fragments 1A3-F(ab')$_2$. *J. Nucl. Med.*, 36:850–858.

Connett et al. (abs) 1993) Cu-67 and Cu-64 labeled -Monoclonal Antibody (MAb) 1A3 as Potential Agents for Radioimmunotherapy. *J Nucl Med.*, 34:216P.

Ferrier et al. (1983) On-line Production of $^{13}$N-Nitrogen Gas from a Solid Enriched $^{13}$C-Target and its Application to $^{13}$N-Ammonia Synthesis Using Microwave Radiation. *Appl. Radiat. Isot.*, Vol. 34, 897–900.

Guillaume et al. (1988) Automated Production of Potassium-38 for the Study of Myocardial Perfusion using Positron Emission Tomography. *Appl. Radiat. Isot.*, Vol. 39, 97–107.

Herr and Botte (1950) Preparation of Practically Carrier-free Copper-64 from High Activity Copper Phthalocyanine. *Z. Nature Forsch.*, 5a, 629.

Hetherington et al. (1986) The Preparation of High Specific Activity Copper-64 for Medical Diagnosis. *Appl. Radiat. Isot.* Vol. 37, No. 12, pp. 1242–1243.

Maziere et al. (1983) [$^{55}$Co]- and [$^{64}$Cu]DTPA: New Radiopharmaceuticals for Ouantitative Tomocisternography. *Appl. Radiat. Isot.* Vol. 34, No. 3, pp. 595–601.

Mirzadeh et al. (1986) Production of No-Carrier Added $^{67}$Cu. *Appl. Radiat. Isot.*, Vol. 37, 29–36.

Mushtag and Qaim (1989) Excitation Functions of α- and $^{3}$He-Particle Induced Nuclear Reactions on Natural Germanium: Evaluation of Production Routes for $^{73}$Se. Institut für Chemie 1 (Nuklearchemie), Kernforschungsanlage Jülich GmbH, D-5170 Jülich, Federal Republic of Germany Nickles et al. (January 1991) Production of a Broad Range of Radionuclides with an 11 MeV Proton Cyclotron. *Journal of Labelled Compounds and Radiopharmaceuticals*, Vol. 30, pp. 120–121.

O'Brien Jr. U.S. Pat. No. 4,487,738, Dec. 11, 1984

Philpott et al. (1993) *J. Nucl. Med.*, 34:81P.

Piel et al. (1991) Excitation Functions of p,xn)-Reactions on $^{nat}$Ni and Highly Enriched $^{62}$Ni: Possibility of Production of Medically Import ant Radioisotope $^{62}$Cu at a Small Cyclotron. Institut für Nuklearchemie, Forschugszentrum J ülich GmbH. D-5170 Jülich, Federal Republic of Germany.

Piel et al. *Radiochim Acta* 57:1 1992.

Rösch and Qaim (1993) Nuclear Data Relevant to the Production of the Positron Emitting Technetium Isotope $^{94m}$Tc via the $^{94}$Mo(p,n)-reaction. *Radiochimica Acta* 62, 115–21.

Sharma et al. (1986) Production of Cobalt-55, a Short-lived, Positron Emitting Radiolabel for Bleomycin. *Appl. Radiat. Isot.*, Vol. 37, 105–109.

Szelecsenyi et al. (1993) Excitation Functions of Proton Induced Nuclear Reactions on Enriched $^{64}$Ni and $^{64}$Ni: Possibility of Production of No-carrier-added $^{61}$Cu and $^{64}$Cu at a Small Cyclotron. *Appl. Radiat. Isot.*, Vol. 44, 575–580.

Vaalburg et al. (1985) Fast Recovery by Dry Distillation of $^{75}$Br Induced in Reusable Metal Selenide Targets via the $^{76}$Se(p,2n)$^{75}$Br Reaction. *Appl. Radiat. Isot.*, Vol. 36, 961–964.

Zinn et al. (1993)Production and Purification of High Specific Activity Cu-64 for PET Imaging. *J. Nucl. Med.*, 34,238P.

Zweit et al. (1991) Excitation Functions for Deuteron Induced Reactions in Natural Nicke 1: Production of No-carrier-added 64Cu from Enriched 64Ni Targets for Positron Emission Tomography. *Appl. Radiat. Isot.*, 42, 193–197.

We claim:

1. A method for producing a radionuclide from a target nuclide using an accelerator capable of generating a beam of charged particles at energies of at least about 5 MeV, the method comprising loading a solid target comprising the target nuclide in a target holder mounted in line with the charged-particle beam generated by the accelerator and adapted to releasably hold the target in position for irradiation by the charged-particle beam, irradiating the target held by the target holder with the charged-particle beam at energies of at least about 5 MeV to form the radionuclide, removing the irradiated target from the target holder, transferring the removed irradiated target to an automated separation system, and separating the radionuclide from unreacted target nuclide using the automated separation system.

2. The method as set forth in claim 1 wherein the step of transferring the removed irradiated target to the separation system includes conveying the irradiated target through a fluid conveyance system comprising a transfer fluid moving through a transfer line.

3. The method as set forth in claim 2 wherein the transfer fluid contacts the irradiated target to transfer the irradiated target through the transfer line without using a transfer capsule.

4. The method as set forth in claim 1 wherein the step of transferring the removed irradiated target to the separation system includes transferring the irradiated target from the target holder to a fluid conveyance system, conveying the irradiated target through the conveyance system, and transferring the irradiated target from the conveyance system to the separation system.

5. The method as set forth in claim 1 wherein the target holder comprises an elongated body adapted to sealingly engage the accelerator and a cooling head, the body having an irradiation chamber and a front seat adapted to sealingly receive the target, the front seat having an aperture for allowing fluid communication between the irradiation chamber and the target, the cooling head including a cavity and a back seat adapted to sealingly receive the target, the back seat having an aperture for allowing fluid communication between the cavity and the target, the head being retractable from the body to allow for loading and unloading the target from the target holder and being engageable with the body to hold the target against the front seat of the body during irradiation, and wherein the step of loading the target in the target holder comprises positioning the target against the front seat of the body or the back seat of the cooling head and drawing a vacuum in the irradiation chamber or in the cavity, respectively, to hold the target in such position at least until the head is engaged with the chamber.

6. The method as set forth in claim 1 wherein the target holder comprises an elongated body and a cooling head, the body including an irradiation chamber and a front seat adapted to sealingly receive the target, the front seat having an aperture for allowing fluid communication between the irradiation chamber and the target, the cooling head including a cavity and a back seat adapted to sealingly receive the target, the back seat having an aperture for allowing fluid communication between the cavity and the target, the cooling head being retractable from the body to allow for loading and unloading the target from the target holder and being engageable with the body to hold the target against the front seat of the body during irradiation, and wherein the step of removing the irradiated target from the target holder comprises retracting the cooling head from the body after the target is irradiated, the irradiated target being held in place against the cooling head seat or against the body seat by vacuum after the cooling head is retracted, and pressurizing the chamber or the cavity, the pressure being effective to act through the aperture in the front seat or back seat, respectively, to separate the target from the front seat or back seat and eject the target for further processing.

7. The method as set forth in claim 1 wherein the target is irradiated with a charged particle beam generated in a low or medium energy accelerator at a beam energy ranging from about 5 MeV to about 25 MeV.

8. The method as set forth in claim 1 wherein the target nuclide is $^{64}$Ni and the target is irradiated with protons to form $^{64}$Cu according to the reaction $^{64}$Ni(p,n)$^{64}$Cu.

9. A method for producing a radionuclide from a target nuclide using an accelerator capable of generating a beam of charged particles at energies of at least about 5 MeV, the method comprising loading a solid target comprising the target nuclide in a target holder, irradiating the target with the charged-particle beam at energies of at least about 5 MeV to form the radionuclide, transferring the irradiated target from the target holder to a fluid conveyance system comprising a transfer fluid moving through a transfer line, conveying the irradiated target using the conveyance system, and separating the radionuclide from unreacted target nuclide.

10. The method as set forth in claim 9 wherein the irradiated target is removed from the target holder prior to being conveyed to the conveyance system.

11. The method as set forth in claim 9 wherein the transfer fluid contacts the irradiated target to transfer the irradiated target through the transfer line without using a transfer capsule.

12. A method for producing a radionuclide from a target nuclide using an accelerator capable of generating a beam of charged particles at energies ranging from about 5 MeV to about 25 MeV, the method comprising loading a solid target in a target holder adapted for use with the accelerator, the target comprising a substrate consisting essentially of an inert material and a target layer electroplated on a surface of the substrate, the target laver consisting essentially of a target nuclide capable of reacting with charged particles generated by the accelerator at energies ranging from about 5 MeV to about 25 MeV to form the radionuclide and having a projected thickness that will produce at least about 50% of the thick target yield for the reaction, irradiating the target with a beam of charged particles generated by the accelerator for at least about one hour to form the radionuclide, the beam having an energy ranging from about 5 MeV to about 25 MeV and a current sufficient to produce a clinically significant yield of the radionuclide, removing the irradiated target from the target holder, transferring the removed irradiated target to an automated separation system, and separating the radionuclide from unreacted target nuclide using the automated separation system.

13. A method for producing a radionuclide from a target nuclide using an accelerator capable of generating a beam of charged particles at energies ranging from about 5 MeV to about 25 MeV, the method comprising loading a solid target in a target holder adapted for use with the accelerator, the target comprising a substrate consisting essentially of an inert material and a target layer electroplated on a surface of the substrate, the target layer consisting essentially of a target nuclide capable of reacting with charged particles generated by the accelerator at energies ranging from about 5 MeV to about 25 MeV to form the radionuclide and having a projected thickness that will produce at least about 50% of the thick target yield for the reaction, irradiating the target with a beam of charged particles generated by the accelerator for at least about one hour to form the radionuclide, the beam having an energy ranging from about 5 MeV to about 25 MeV and a current sufficient to produce a clinically significant yield of the radionuclide, transferring the irradiated target from the target holder to a fluid conveyance system conveying the irradiated target using the conveyance system, and transferring the irradiated target from the conveyance system to the separation system.

14. A method for producing $^{64}$Cu suitable for use in preparing a radiopharmaceutical agent for clinical applications, the method comprising loading the target in a target holder suitable for use with an accelerator capable of generating the proton beam at energies greater than about 5 MeV, irradiating a target comprising isotonically enriched $^{64}Ni$ with a proton beam to produce $^{64}Cu$ according to the reaction $^{64}Ni(p,n)^{64}Cu$ in an amount which is at least sufficient for preparing a radioimaging agent, the proton beam having an energy of at least about 5 MeV and a current at least sufficient to produce an amount of $^{64}Cu$ sufficient for clinical use in a radioimaging agent during the period of irradiation, removing the irradiated target from the target holder, transferring the removed irradiated target to an automated separation system suitable for separating $^{64}Cu$ from unreacted $^{64}Ni$, and separating $^{64}Cu$ from unreacted $^{64}Ni$, the separated $^{64}Cu$ having a specific activity at least sufficient for clinical use in a radioimaging agent.

15. The method as set forth in claim 12 wherein the target layer has a projected thickness that will produce at least about 75% of the thick target yield.

16. The method as set forth in claim 12 wherein the target layer has dimensions that define a target area and the charged-particle beam impinges the target over an area which substantially matches the target area.

17. The method as set forth in claim 12 wherein the charged-particles generated by the accelerator travel unimpeded from the accelerator to the target during irradiation without passing through an attenuating foil or window.

18. The method as set forth in claim 12 wherein the target nuclide is $^{64}Ni$ and the target is irradiated with protons to form $^{64}Cu$ according to the reaction $^{64}Ni(p,n)^{64}Cu$.

19. The method as set forth in claim 13 wherein the target layer has a projected thickness that will produce at least about 75% of the thick target yield.

20. The method as set forth in claim 13 wherein the target layer has dimensions that define a target area and the charged-particle beam impinges the target over an area which substantially matches the target area.

21. The method as set forth in claim 13 wherein the charged-particles generated by the accelerator travel unimpeded from the accelerator to the target during irradiation without passing through an attenuating foil or window.

22. The method as set forth in claim 13 wherein the target nuclide is $^{64}Ni$ and the target is irradiated with protons to form $^{64}Cu$ according to the reaction $^{64}Ni(p,n)^{64}Cu$.

23. The method as set forth in claim 14 wherein the amount of $^{64}Cu$ produced is at least an amount sufficient for preparing a radiotherapeutic agent and the specific activity of the separated $^{64}Cu$ is sufficient for clinical use in a radiotherapeutic agent.

24. The method as set forth in claim 14 wherein the target is irradiated for at least about ½ hour with a proton beam having a current sufficient to produce at least about 100 mCi of $^{64}Cu$ in less than about 24 hours.

25. The method as set forth in claim 14 wherein the $^{64}Ni$ comprises less than about 250 ppm by weight carrier copper, and the target is irradiated for at least about 1 hour with a proton beam having an energy ranging from about 5 MeV to about 25 MeV and a current sufficient to produce at least about 200 mCi of $^{64}Cu$ in less than about 12 hours.

26. The method as set forth in claim 14 wherein the amount of $^{64}Cu$ produced is at least about 10 mCi.

27. The method as set forth in claim 14 wherein the amount of $^{64}Cu$ produced is at least about 100 mCi.

28. The method as set forth in claim 14 wherein the separated $^{64}Cu$ has a specific activity of at least about 15 mCi/$\mu$g Cu.

29. The method as set forth in claim 14 wherein the separated $^{64}Cu$ has a specific activity of at least about 100 mCi/$\mu$g Cu.

30. The method as set forth in claim 14 wherein the beam energy ranges from about 5 MeV to about 25 MeV.

31. The method as set forth in claim 30 wherein the beam current ranges from about 1 $\mu$A to about 1 mA at about 5 MeV, to about 150 $\mu$A at about 8 MeV, to about at 100 $\mu$A at about 11 MeV, to about 60 $\mu$A at about 25 MeV and to about 45 $\mu$A at about 25 MeV.

32. The method as set forth in claim 14 wherein the target comprises a substrate and a target layer formed on a surface of the substrate, the target layer consisting essentially of isotopically enriched $^{64}Ni$ and having a projected thickness of at least about 20 $\mu$m, the substrate consisting essentially of an inert material having a thermal conductivity which is about equal to or greater than the thermal conductivity of $^{64}Ni$.

33. The method as set forth in claim 32 wherein the target layer is an electroplated target layer.

34. The method as set forth in claim 32 wherein the target layer consists essentially of $^{64}Ni$ enriched to at least about 95% and has a projected thickness ranging from about 20 $\mu$m to about 500 $\mu$m, and the substrate consists essentially of gold and has a front surface, a back surface substantially parallel to and opposing the front surface and a thickness ranging from about 0.5 mm to about 2 mm.

35. The method as set forth in claim 32 wherein the $^{64}Ni$ target is irradiated with a proton beam having an energy ranging from about 5 MeV to about 25 MeV, the method further comprising loading the $^{64}Ni$ target in a target holder adapted for use with a proton accelerator capable of generating a proton beam at energies ranging from about 5 MeV to about 25 MeV, the target holder including an elongated body and a cooling head, the body having an irradiation chamber and a front seat adapted to sealingly engage the target, the front seat having an aperture for allowing fluid communication between the irradiation chamber and the target, the cooling head having a cavity and a back seat adapted to sealingly engage the target, the back seat having an aperture for allowing fluid communication between the cavity and the target, the cooling head being retractable from the body to allow for loading and unloading the target from the target holder and being engageable with the body to hold the target against the body during irradiation, the target being loaded in the target holder by positioning the target against the front seat of the body or the back seat of the cooling head and drawing a vacuum in the chamber or in the cavity, respectively, to hold the target in such position before the cooling head is engaged, engaging the cooling head to hold the target against the body, after the target is irradiated, retracting the cooling head from the body and holding the irradiated target in place against the cooling head or against the body by vacuum after the cooling head is retracted, and unloading the irradiated target from the target holder by pressurizing the chamber or the cavity, the pressure being effective to act through the aperture in the front seat or back seat, respectively, to separate the target from the front seat or back seat and eject the target for further processing.

36. The method as set forth in claim 14 wherein the target comprises a target layer formed over a surface of a substrate, the target layer including, after irradiation, $^{64}cu$, unreacted $^{64}Ni$ and other radionuclides, and $^{64}Cu$ is separated from unreacted $^{64}Ni$ and from the substrate layer using a separation unit, the separation unit including a shielded housing that encloses components arranged to facilitate automatic and remote separation of the $^{64}Cu$, the components being selected from the group consisting of one or more fluid containers, an ion exchange column, and one or more pipetters in isolable fluid communication with the containers or the column, the $^{64}Cu$ being separated by exposing the target to an acidic solution in the dissolution vessel to dissolve the target layer off of the substrate, thereby forming a target-layer solution comprising $^{64}Cu$, $^{64}Ni$ and other radionuclides, passing the target-layer solution through the anion-exchange column and collecting a first eluate therefrom, the first eluate being substantially enriched in nickel relative to copper, and passing water or an acidic solution having a normality of about 0.5 N through the anion-exchange column and collecting a second eluate therefrom, the second eluate being substantially enriched in $^{64}Cu$ relative to other radionuclides or impurities.

37. The method as set forth in claim 36 wherein the pipetters include a plunger and the acid solution in the dissolution vessel is agitated while the irradiated target is exposed to the acid solution by effecting repetitive upward and downward movements of the pipetter plunger in fluid communication with the dissolution vessel.

38. The method as set forth in claim 14 further comprising, after the step of separating the radionuclide from unreacted target nuclide, recycling the unreacted $^{64}Ni$ for use in preparing another target.

* * * * *

UNITED STATES PATENT AND TRADEMARK OFFICE

CERTIFICATE OF CORRECTION

PATENT NO : 6,011,825

DATED : January 4, 2000

INVENTOR(S) : Michael J. Welch, et al.

It is certified that error appears in the above-identified patent and that said Letters Patent are hereby corrected as shown below:

Title page, item [73], the Assignee should read ---Washington University, St. Louis, Missouri; Newton Scientific, Inc., Winchester, Massachusetts---.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*